United States Patent [19]

Shirai et al.

[11] Patent Number: 4,501,807

[45] Date of Patent: Feb. 26, 1985

[54] PHOTOCONDUCTIVE MEMBER HAVING AN AMORPHOUS SILICON LAYER

[75] Inventors: Shigeru Shirai, Yamato; Kyosuke Ogawa, Sakurashin; Junichiro Kanbe, Yokohama; Keishi Saitoh, Tokyo; Yoichi Osato, Yokohama; Teruo Misumi, Kawasaki, all of Japan

[73] Assignee: Canon Kabushiki Kaisha, Tokyo, Japan

[21] Appl. No.: 473,278

[22] Filed: Mar. 8, 1983

[30] Foreign Application Priority Data

| | | | |
|---|---|---|---|
| Mar. 8, 1982 | [JP] | Japan | 57-36918 |
| Mar. 8, 1982 | [JP] | Japan | 57-36919 |
| Mar. 9, 1982 | [JP] | Japan | 57-37437 |
| Mar. 25, 1982 | [JP] | Japan | 57-37438 |
| Mar. 25, 1982 | [JP] | Japan | 57-47800 |
| Mar. 25, 1982 | [JP] | Japan | 57-47801 |
| Mar. 25, 1982 | [JP] | Japan | 57-47802 |
| Mar. 25, 1982 | [JP] | Japan | 57-47803 |

[51] Int. Cl.[3] ..... G03G 5/082

[52] U.S. Cl. ..... 430/57; 430/65; 430/84; 430/95

[58] Field of Search ..... 430/66, 65, 84, 95

[56] References Cited

U.S. PATENT DOCUMENTS

| | | | |
|---|---|---|---|
| 4,361,638 | 11/1982 | Higashi et al. | 430/66 |
| 4,414,319 | 11/1983 | Shirai et al. | 430/65 |

*Primary Examiner*—John E. Kittle
*Assistant Examiner*—John L. Goodrow
*Attorney, Agent, or Firm*—Fitzpatrick, Cella, Harper & Scinto

[57] ABSTRACT

A photoconductive member comprising a support for photoconductive member and an amorphous layer exhibiting photoconductivity comprising an amorphous material containing silicon atoms as a matrix is characterized in that said amorphous layer has a first layer region containing, as constituent atoms, oxygen atoms in a distribution which is nonuniform and continuous in the direction of the layer thickness and a second layer region containing, as constituent atoms, the atoms (A) belonging to group III or group V of the periodic table in a distribution which is continuous in the direction of the layer thickness, said second layer existing internally beneath the surface of said amorphous layer.

25 Claims, 17 Drawing Figures

PHOTOCONDUCTIVE MEMBER HAVING AN AMORPHOUS SILICON LAYER

BACKGROUND OF THE INVENTION

1. Field of the Invention

This invention relates to a photoconductive member having sensitivity to electromagnetic waves such as light (herein used in a broad sense, including ultraviolet rays, visible light, infrared rays, X-rays, gamma-rays, and the like).

2. Description of the Prior Art

Photoconductive materials which constitute photoconductive layers for solid state image pick-up devices, electrophotographic image-forming member in the field of image formation, or manuscript reading devices, are required to have a high sensitivity, a high SN ratio (Photocurrent ($I_p$)/Dark current ($I_d$)), spectral characteristics matching those of the electromagnetic waves to be irradiated, a rapid response to light, a desired dark resistance value as well as no harm to human bodies during usage. Further, in a solid state image pick-up device, it is also required that the residual image should easily be treated within a predetermined time. In particular, in case of an image forming member for electrophotography to be assembled in an electrophotographic device to be used in an office as office apparatus, the aforesaid harmless characteristic is very important.

From the standpoint as mentioned above, amorphous silicon (hereinafter referred to as a-Si) has recently attracted attention as a photoconductive material. For example, German Laid-Open Patent Publication Nos. 2746967 and 2855718 disclose applications of a-Si for use in image forming members for electrophotography, and German Laid-Open Patent publication No. 2933411 an application of a-Si for use in a photoelectric converting reading device.

However, under the present situation, while the photoconductive members having photoconductive layers constituted of a-Si have been attempted to be improved in various aspects individually including electrical, optical and photoconductive characteristics such as dark resistance value, photosensitivity and response to light, etc., and environmental characteristics, and further stability with lapse to time and durability, there remains room for further improvement of overall characteristics.

For instance, when applied in an image forming member for electrophotography, residual potential is frequently observed to remain during use thereof if improvements to higher photosensitivity and higher dark resistance are scheduled to be effected at the same time. When such a photoconductive member is repeatedly used for a long time, there will be caused various inconveniences such as accumulation of fatigues by repeated uses or a so-called ghost phenomenon wherein residual images are formed.

Further, a-Si materials may contain as constituent atoms hydrogen atoms or halogen atoms such as fluorine atoms, chlorine atoms, etc. for improving their electrical, photoconductive characteristics, boron atoms, phosphorus atoms, etc. for controlling the electroconduction type as well as other atoms for improving other characteristics. Depending on the manner in which these constituent atoms are contained, there may sometimes be caused problems with respect to electrical, photoconductive characteristics or dielectrical strength of the layer formed.

That is, for example, when used as an image forming member for electrophotography, the life of the photocarriers generated by light irradiation in the photoconductive layer formed is insufficient therein, or at the dark portion, the charges injected from the support side cannot sufficiently be impeded, or there occurred image defects commonly called "blank areas" on the images transferred on a transfer paper which may be considered to be due to the local discharge destroying phenomenon, or image defects commonly called "white streaks" which may be considered to be caused by, for example, scraping with a blade employed for cleaning. Also, when used in a highly humid atmosphere or immediately after being left to stand in a highly humid atmosphere for a long time, so called "unclearness" was frequently observed in images obtained.

Further, when the layer thickness is as thick as ten or so microns or higher, there tend to occur such phenomena as loosening or peeling of layers from the support surface of formation of cracks in the layers with passage of time when left to stand after being taking out of vacuum deposition chamber for layer formation. These phenomena will occur particularly frequently when the support is a drum-shaped support conventionally employed in the field of electrophotography. Thus, there are problems to be solved with respect to stability with lapse of time.

Thus, it is required in designing of a photoconductive material to make efforts to solve all of the problems as mentioned above along with the improvement of a-Si materials per se.

In view of the above points, the present invention contemplates the achievement obtained as a result of extensive studies made comprehensively from the standpoint of applicability and utility of a-Si as a photoconductive member used for electrophotographic image forming members, solid stage image pick-up devices, reading devices, etc. It has now been found that a photoconductive member having a photoconductive layer comprising an amorphous layer, which comprises a-Si, particularly so-called hydrogenated amorphous silicon, halogenated amorphous silicon, or halogen-containing hydrogenated amorphous silicon which is an amorphous material containing at least one hydrogen atom (H) and halogen atom (X) in a matrix of silicon atoms (hereinafter referred to comprehensively as a-Si(H,X)), said photoconductive member being prepared by design so as to have a specific layer structure is found to exhibit not only practically extremely excellent characteristics but also to surpass the photoconductive members of the prior art in substantially all respects, especially markedly excellent characteristics as a photoconductive member for electrophotography. The present invention is based on such finding.

SUMMARY OF THE INVENTION

A primary object of the present invention is to provide a photoconductive member having electrical, optical and photoconductive characteristics which are substantially constantly stable with virtually no dependence on the environmental conditions under use, which member is markedly excellent in light fatigue resistance and also excellent in humidity resistance and durability without causing deterioration phenomena when used repeatedly, exhibiting no or substantially no residual potential.

Another object of the present invention is to provide a photoconductive member which is excellent in adhesion between a support and a layer provided on the support or between respective laminated layers, stable with closeness of structural arrangement and high in layer quality.

Another object of the present invention is to provide a photoconductive member having sufficient ability to retain charges during charging treatment for formation of electrostatic images, when applied as a member for formation of an electrophotographic image, and having excellent electrophotographic characteristics, for which ordinary electrophotographic methods can very effectively be applied.

Still another object of the present invention is to provide a photoconductive member for electrophotography capable of providing easily a high quality image which is high in density, clear in halftone, high in resolution and free from image defect and faint image upon use for long time.

Further, still another object of the present invention is to provide a photoconductive member having a high photosensitivity, a high SN ratio characteristic and a high dielectric strength.

Further, still another object of the present invention is to provide a photoconductive member which comprises a support for photoconductive member, an amorphous layer exhibiting photoconductivity comprising an amorphous material containing at least one of hydrogen atoms and halogen atoms as constituent atoms in a matrix of silicon atoms, said amorphous layer having a first layer region (O) containing, as constituent atoms, oxygen atoms in a distribution which is nonuniform and continuous in the direction of the layer thickness and a second layer region (A) containing, as constituent atoms, the atoms (A) belonging to the group III or the group V of the periodic table in a distribution which is continuous in the direction of the layer thickness, said second layer existing internally beneath the surface of said amorphous layer.

DESCRIPTION OF THE PREFERRED EMBODIMENTS

Figure 1:
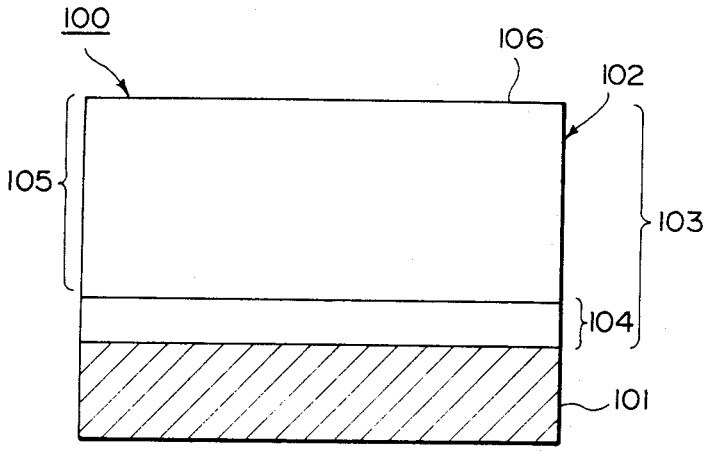
FIG. 1 and FIG. 2 show schematic sectional views for illustration of preferred embodiments of the constitution of the photoconductive member according to the present invention, respectively.

Referring now to the drawings, the photoconductive member of the present invention is to be described in detail.

FIG. 1 shows a schematic sectional view for illustration of a preferable exemplary constitution of the photoconductive member of this invention.

The photoconductive member 100 as shown in FIG. 1 has a support 101 for photoconductive member and an amorphous layer 102 comprising a-Si(H,X) exhibiting photoconductivity provided on the support.

The amorphous layer (I) 102 has a layer structure constituted on a first layer region (O) 103 which occupies wholly of said amorphous layer and contains as constituent atoms oxygen atoms, a second layer region (A) 104 containing atoms (A) belonging to either the group III (the group III atoms) or the group V (the group V atoms) of the periodic table as constituent atoms and a surface layer region 105 containing oxygen atoms but none of the atoms (A) on the second layer region (A) 104.

The oxygen atoms contained in the first layer region (O) 103 are distributed in said layer region (O) 103 continuously in the direction of the layer thickness in a nonuniform distribution, but preferably in a distribution continuous and uniform in the direction substantially parallel to the surface of the support 101.

The photoconductive member 100 shown in FIG. 1 has a layer region (105) containing none of the atoms (A) provided on the surface portion of the amorphous layer 102.

The atoms (A) to be contained in the second layer region (A) 104 are distributed in said layer region (A) continuously in the direction of layer thickness and in a nonuniform distribution, but preferably in a distribution continuous and uniform in the direction substantially parallel to the surface of the support 101.

In the photoconductive member according to the present invention, improvements of higher dark resistance and better adhesion between the amorphous layer and the support on which it is directly provided or between the amorphous layer or other layers are intended preponderantly by incorporation of oxygen atoms in the first layer region (O). In particular, better results may be obtained in case of layer structures, where as shown in the photoconductive member 100 in FIG. 1 the amorphous layer 102 has a first layer region (O) 103 containing oxygen atoms, a second layer region (A) 104 containing the atoms (A), and a layer region 105 containing no atoms (A), said first layer region (O) 103 and said second layer region (A) 104 sharing a common layer region.

Also, in the photoconductive member of the present invention, the distribution of oxygen atoms contained in the first layer region is made in the first place in the direction of its layer thickness so as to be more enriched toward the support side or the bonded interface side with another layer for improvement of adhesion and contact with the support on which said first layer region (O) is provided or with another layer. Secondly, the oxygen atoms contained in the above first layer region (O), in order to make the layer region provided on the side opposite to the support highly sensitive to the light irradiation from the side opposite to the support, many preferably be contained in the first layer region (O) so that its distribution concentration may be gradually decreased toward the side opposite to the support until the concentration of oxygen atoms may be substantially zero at the surface on the side opposite to the support. The atoms (A) to be contained in the second layer region (A) may be distributed in a depth profile such that the concentration of the atoms (A) in the second layer region (A) is continuous and uniform in the layer thickness direction and also continuous and uniform within a plane parallel to the surface of the support.

In the present invention, the atoms belonging to the group III of the periodic table to be incorporated in the second layer region (A) constituting the amorphous layer may include B (boron). Al (aluminum), Ga (gallium), In (indium) and Tl (thallium). Among them, B and Ga are particularly preferred.

As the atoms belonging to the group V of the periodic table, there may be employed P (phosphorus), As (arsenic), Sb (antimony), Bi (Bismuth), particularly preferably P and As.

In the present invention, the content of the atoms (A) in the second layer region (A), which may be suitably determined as desired so as to achieve effectively the object of the present invention, may be preferably 0.01 to $5\times10^4$ atomic ppm, more preferably 0.05 to $1\times10^4$ atomic ppm, most preferably 1 to $5\times10^3$ atomic ppm. The content of oxygen atoms, in the first layer region (O) may also be determined suitably depending on the characteristics required for the photoconductive member formed, but preferably 0.001 to 30 atomic %, more preferably 0.002 to 20 atomic %, most preferably 0.003 to 10 atomic %.

In the photoconductive member according to the present invention, there are provided the first layer region (O) containing oxygen atoms which constitutes the whole layer region of the amorphous layer, partly because of intending to improve adhesion between the amorphous layer and the support or other layers, and the second layer region (A) containing the atoms (A) which constitutes a part of the amorphous layer, partly because of intending to preventing injection of charges into the amorphous layer from the support side when subjected to the charging treatment from the side of the surface of the amorphous layer opposite to the support, respectively, so that the first layer region and the second layer region share in common at least a portion of said mutual region and said portion being located at the support or other layers.

In the photoconductive member according to the present invention, the second layer region (A) containing the atoms (A), when the purpose of its provision is primarily prevention of injection of charges between the amorphous layer and the support, from the support side into the amorphous layer, is required to be distributed unevenly so as to be more enriched as far as possible toward the support side in the amorphous layer.

In such a case, it is desirable that the following relation may be valid between the layer thickness $t_B$ of the second layer region (A) containing the atoms (A) (the layer thickness of 104 is FIG. 1) and the layer thickness T of the layer region excluding the portion of the second layer region (A) (the layer region 105 in FIG. 1) provided on the second layer region:

$$t_B/(T+t_B)\leqq 0.4.$$

More preferably, the value of the above correlation formula may be 0.35 or less, most preferably 0.3 or less.

Also, as the layer thickness $t_B$ of the second layer region (A) containing the atoms (A), it may preferably 30 Å to 5μ, more preferably 40 Å to 4μ, most preferably 50 Å to 3μ.

On the other hand, the sum of the above layer thickness T and the layer thickness ($t_B$, $(T+t_B)=T_o$ may preferably be 1 to 100μ, more preferably 1 to 80μ, most preferably 2 to 50μ.

In the photoconductive member in the present invention, the amorphous layer is constituted of the second amorphous layer (A) containing the atoms (A) which is provided in an uneven distribution toward the support side and the remainder portion containing no atom (A) excluding said layer region (A), the layer thickness T of the layer region containing no atom (A) suitably be determined in designing of the layers depending on the characteristics required for the photoconductive member to be formed. In the present invention, the layer thickness T may preferably be 0.1 to 90μ, more preferably 0.5 to 80μ, most preferably 1 to 70μ.

FIG. 3 through FIG. 11 show typical examples of the depth profiles of oxygen atoms contained in the first layer region (O) constituting the amorphous layer of the photoconductive member in the present invention.

In FIG. 3 through FIG. 11, the abscissa shows the content C of oxygen atoms, while the ordinate shows the layer thickness of the first layer region (O) containing oxygen atoms, $t_B$ indicating the position of the interface with the support and $t_T$ the position of the interface on the side opposite to the support side. That is, the first layer region (O) containing oxygen atoms is formed in the direction from the $t_B$ side toward the $t_T$ side.

In the present invention, the first layer region (O) containing oxygen atoms is constituted primarily of a-Si(H,X) which occupies the whole layer region of the amorphous layer exhibiting photoconductivity.

Figure 3:
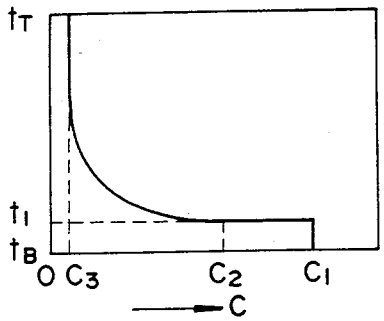
FIG. 3 through FIG. 11 show schematic charts for illustration of the depth profiles of oxygen atoms in the layer region (O) constituting the amorphous layer of the present invention, respectively.

FIG. 3 shows a first typical example of the depth profile of oxygen atoms contained in the first layer region (O) in the direction of the layer thickness.

In the example as shown in FIG. 3, from the interface position $t_B$, at which the surface on which the first layer region (O) containing oxygen atoms is to be formed is contacted with the surface of said first layer region (O), to the position of $t_1$, oxygen atoms are contained in the first layer region (O), with the concentration of oxygen atoms taking a constant value of $C_1$, said concentration being gradually decreased from the position $t_1$ to the interface $t_T$ from the concentration $C_2$. At the interface position $t_T$, the concentration C is made $C_3$.

Figure 4:
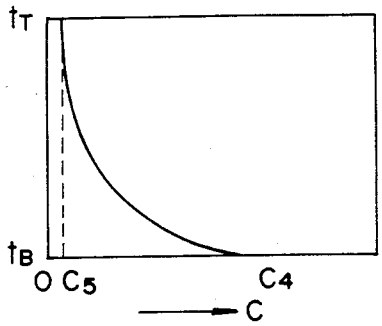

In the example shown in FIG. 4, the concentration C of the oxygen atoms contained is decreased gradually and continuously from the position $t_B$ to the position $t_T$ from the concentration $C_4$ until it becomes the concentration $C_5$ at the position $t_T$.

Figure 5:
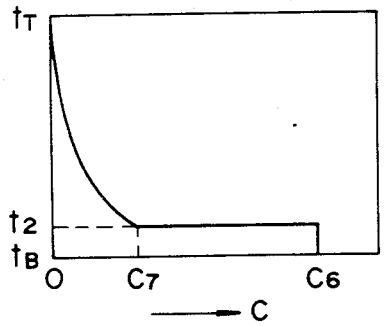

In case of FIG. 5, the concentration C of oxygen atoms is made constant as $C_6$ between the position $t_B$ and the position $t_2$, gradually decreased from the position $t_2$ to the position $t_T$, and the concentration C is made substantially zero at the position $t_T$.

Figure 6:
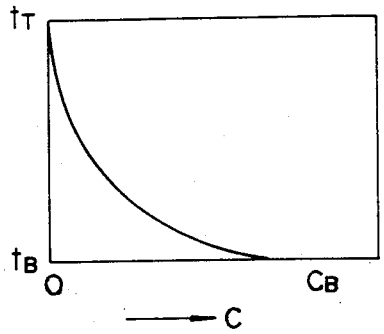

In case of FIG. 6, the concentration C of oxygen atoms is decreased gradually and continuously from the position $t_B$ to the position $t_T$ from the concentration $C_8$, until it is made substantially zero at the position $t_T$.

Figure 7:
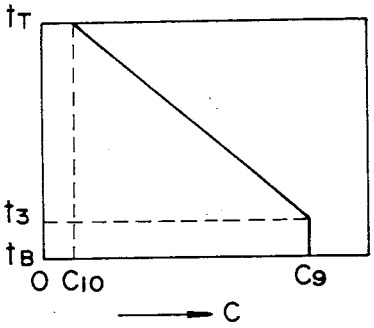

In the example shown in FIG. 7, the concentration C of oxygen atoms is constantly $C_9$ between the position $t_B$ and the position $t_3$, and it is made $C_{10}$ at the position $t_T$. Between the position $t_3$ and the position $t_T$, the concentration C is decreased as a first order function from the position $t_3$ to the position $t_T$.

Figure 8:
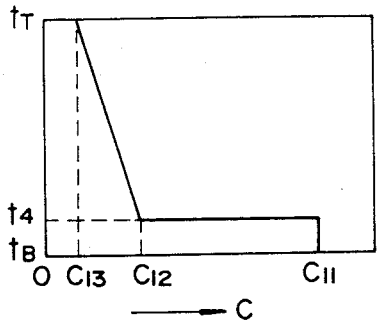

In the example shown in FIG. 8, there is formed a depth profile such that the concentration takes a constant value $C_{11}$ from the position $t_B$ to the position $t_4$, and is decreased as a first order function from the concentration $C_{12}$ to the concentration $C_{13}$ from the position $t_4$ to the position $t_T$.

Figure 9:
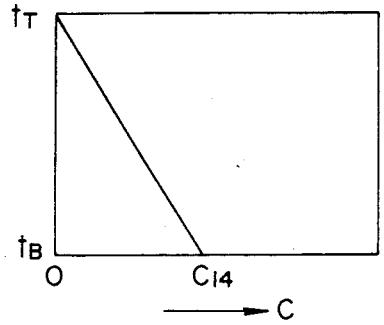

In the example shown in FIG. 9, the concentration C of oxygen atoms is decreased as a first order function from the concentration $C_{14}$ to zero from the position $t_B$ to the position $t_T$.

Figure 10:
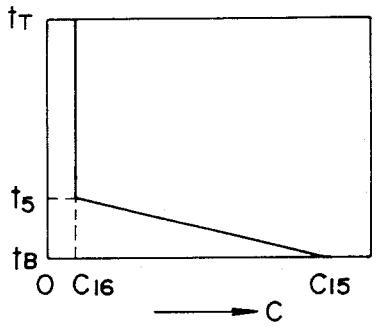

In FIG. 10, there is shown an example, where the concentration C of oxygen atoms is decreased as a first order function from the concentration $C_{15}$ to $C_{16}$ from the position $t_B$ to $t_T$ and constant at the concentration $C_{16}$ between the position $t_5$ and $t_T$.

Figure 11:
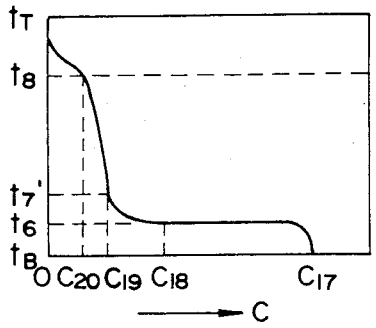

In the example shown in FIG. 11, the concentration C of oxygen atoms is $C_{17}$ at the position $t_B$, which concentration $C_{17}$ is initially decreased gradually and they abruptly near the position $t_6$, until it is made the concentration $C_{18}$ at the position $t_6$.

Between the position $t_6$ and the position $t_7$, the concentration C is initially decreased abruptly and thereafter gradually, until it is made the concentration $C_{19}$ at the position $t_7$. Between the position $t_7$ and the position $t_8$, the concentration C is decreased very gradually to the concentration $C_{20}$ at the position $t_8$. Between the position $t_8$ and the position $t_T$, the concentration C is decreased along the curve having a shape as shown in the FIG. 11 from the concentration $C_{20}$ to substantially zero.

As described according to FIGS. 3 to 11 some typical examples of the depth profiles of oxygen atoms contained in the first layer region (O) in the direction of the layer thickness, in the present invention, the first layer region (O) may preferably be provided in the amorphous layer in a depth profile so as to have a portion enriched in concentration C of oxygen atoms on the support side and a portion depleted in concentration C of oxygen atoms to considerably lower than that of the support side on the interface $t_T$ side.

The layer region (O) containing oxygen atoms which constitutes the amorphous layer has a localized region (A) containing oxygen atoms at a relatively higher concentration on the support side.

The localized region (A), as explained in terms of the symbols shown in FIG. 3 through FIG. 11, may be desirably provided within 5μ from the interface position $t_B$.

The above localized region (A) may be made to be identical with the whole layer region ($L_T$) up to the depth of 5μ thickness, or alternatively a part of the layer region ($L_T$).

It may suitably be determined depending on the characteristics required for the amorphous layer to be formed, whether the localized region (A) is made a part or whole of the layer region ($L_T$).

The localized region (A) may preferably be formed according to such a layer formation that the maximum $C_{max}$ of the concentrations in a distribution in the layer thickness direction (depth profile values) may preferably be 10 atomic % or more, more preferably 20 atomic % or more and, most preferably 30 atomic % or more.

That is, according to a preferred embodiment of this invention, the first layer region (O) is formed so that the maximum value $C_{max}$ of the depth profiles may exist within a layer thickness of 5μ from the support side (the layer region within 5μ thickness from $t_B$).

The support to be used in the present invention may be either electroconductive or insulating. As the electroconductive material, there may be mentioned metals such as NiCr, stainless steel, Al, Cr, Mo, Au, Nb, Ta, V, Ti, Pt, Pd etc. or alloys thereof.

As insulating supports, there may conventionally be used films or sheets of synthetic resins, including polyesters, polyethylene, polycarbonates, cellulose acetate, polypropylene, polyvinyl chloride, polyvinylidene chloride, polystyrene, polyamides, etc., glasses, ceramics, papers, and so on. These insulating supports should preferably have at least one surface subjected to electroconductive treatment, and it is desirable to provide other layers on the side at which said electroconductive treatment has been applied.

For example, electroconductive treatment of a glass can be effected by providing a thin film of NiCr, Al, Cr, Mo, Au, Ir, Nb, Ta, V, Ti, Pt, Pd, $In_2O_3$, $SnO_2$, ITO ($In_2O_3+SnO_2$), and the like thereon. Alternatively, a synthetic resin film such as polyester film can be subjected to the electroconductive treatment on its surface by vacuum vapor deposition, electron-beam deposition or sputtering of a metal such as NiCr, Al, Ag, Pb, Zn, Ni, Au, Cr, Mo, Ir, Nb, Ta, V, Ti, Pt, etc. or by laminating treatment with said metal, thereby imparting electroconductivity to the surface. The support may be shaped in any form such as cylinders, belts, plates or others, and its form may be determined as desired. For example, when the photoconductive member 100 in FIG. 1 is to be used as an image forming member for electrophotography, it may desirably be formed into an endless belt or a cylinder for use in continuous high speed copying. The support may have a thickness, which is conveniently determined so that a photoconductive member as desired may be formed. When the photoconductive member is required to have a flexibility, the support is made as thin as possible, so far as the function of a support can be exhibited. However, in such a case, the thickness is generally 10μ or more from the points of ease of fabrication and handling of the support as well as its mechanical strength.

In the present invention, formation of an amorphous layer constituted of a-Si(H,X) may be conducted according to the vacuum deposition method utilizing the discharging phenomenon, such as the glow discharge method, sputtering method or ion-plating method. For example, for formation of an amorphous layer constituted of a-Si(H,X) according to the glow discharge method, the basic procedure comprises introducing a starting gas for introduction of hydrogen atoms (H) and/or halogen atoms (X) together with a starting gas for supplying silicon atoms (Si) into the deposition chamber which can be internally brought to a reduced pressure, and exciting glow discharge in said deposition chamber, thereby forming a layer consisting of a-Si(H,X) on the surface of a support set a predetermined position. For formation of the layer according to the sputtering method, when effecting sputtering of a target constituted of Si in an atmosphere of, for example, an inert gas such as Ar, He, etc. or a gas mixture based on these gases, a gas for introduction of hydrogen atoms (H) and/or halogen atoms (X) may be introduced into the deposition chamber for sputtering. In the present invention, typical examples of halogen atoms (X) which may be optionally incorporated in the amorphous layer are fluorine, chlorine, bromine and iodine, especially preferably fluorine and chlorine.

The starting gas for supplying Si to be used in the present invention may include gaseous or gasifiable hydrogenated silicons (silanes) such as $SiH_4$, $Si_2H_6$, $Si_3H_8$, $Si_4H_{10}$ and others as effective materials. In particular, $SiH_4$ and $Si_2H_6$ are preferred with respect to easy handling during layer formation and efficiency for supplying Si.

Effective starting gases for introduction of halogen atoms to be used in the present invention may include a large number of halogenic compounds, as exemplified by halogen gases, halides, interhalogen compounds, or gaseous or gasifiable halogenic compounds such as silane derivatives substituted with halogens.

Further, there may also be included gaseous or gasifiable silicon compounds containing halogen atoms constituted of silicon atoms and halogen atoms as constituent elements as effective ones in the present invention.

Typical examples preferably used in the present invention may include halogen gases such as of fluorine, chlorine, bromine or iodine, interhalogen compounds such as BrF, ClF, $ClF_3$, $BrF_5$, $BrF_3$, $IF_3$, $IF_7$, Icl, IBr, etc.

As the silicon compounds containing halogen atoms (X), namely so-called silane derivatives substituted with halogens, there may preferably employed silicon halides such as $SiF_4$, $Si_2F_6$, $SiCl_4$, $SiBr_4$, and the like.

When the characteristic photoconductive member of the present invention is to be formed according to the glow discharge method by employment of such a silicon compound containing halogen atoms, it is possible to form an amorphous layer constituted of a-Si containing halogen atoms on a certain support without use of a hydrogenated silicon gas as the starting material capable of supplying Si.

For formation of an amorphous layer containing halogen atoms according to the glow discharge method, the basic procedure comprises introducing a silicon halide gas as the starting material for supplying silicon atoms and a gas such as Ar, $H_2$, He, etc. at a predetermined mixing ratio and gas flow rates into a deposition chamber for formation of the amorphous layer and exciting glow discharging therein to form a plasma atmosphere of these gases, whereby the amorphous layer can be formed on a certain support. For the purpose of introduction of hydrogen atoms, these gases may further be admixed at a desired level with a gas of a silicon compound containing hydrogen atoms.

Also, the respective gases may be used not only as single species but as a mixture of plural species.

For formation of an amorphous layer comprising a-Si(H,X) according to the reactive sputtering method or the ion plating method, for example, in case of the sputtering method, sputtering may be effected by use of a target of Si in a certain gas plasma atmosphere; or in case of the ion plating method, a polycrystalline silicon or a single crystalline silicon is placed as a vapor source in a vapor deposition boat and the silicon vapor source is vaporized by heating according to the resistance heating method, the electron beam method (EB method), or the like and the resultant flying vaporized product is permitted to pass through the gas plasma atmosphere.

During this procedure, in either of the sputtering method or the ion plating method, introduction of halogen atoms into the layer formed may be effected by introducing a gas of a halogen compound or a silicon compound containing halogen atoms as described above into the deposition chamber and forming a plasma atmosphere of said gas.

Also, for introduction of hydrogen atoms, a starting gas for introduction of hydrogen atoms, such as $H_2$, or a gas of silanes such as those mentioned above may be introduced into the deposition chamber and a plasma atmosphere of said gas may be formed therein.

In the present invention, as the starting gas for introduction of halogen atoms, the halogen compounds or silicon compounds containing halogens as mentioned above can effectively be used. In addition, it is also possible to use a gaseous or gasifiable halide containing a hydrogen atom as one of the constitutents such as hydrogen halide, including HF, HCl, HBr, HI, and the like or halogen-substituted hydrogenated silicon, including $SiH_2F_2$, $SiH_2I_2$, $SiH_2Cl_2$, $SiHCl_3$, $SiH_2Br_2$, $SiHBr_3$, and the like as an effective starting material for formation of an amorphous layer.

These halides containing a hydrogen atom, which can introduce hydrogen atoms very effective for controlling electrical or photoelectric characteristics into the layer during formation of the amorphous layer simultaneously with introduction of halogen atoms, can preferably be used as the starting material for introduction of halogen atoms.

For incorporation of hydrogen atoms structurally into the amorphous layer, other than the above method, $H_2$ or a gas of hydrogenated silicon, including $SiH_4$, $Si_2H_6$, $Si_3H_8$, $Si_4H_{10}$ and so on may be permited to be co-present with a silicon compound for supplying Si in a deposition chamber, wherein discharging is excited.

For example, in case of the reactive sputtering method, an Si target is used and a gas for introduction of halogen atoms and $H_2$ gas are introduced together with, if necessary, an inert gas such as He, Ar, etc. into a deposition chamber, wherein a plasma atmosphere is formed to effect sputtering of said Si target, thereby forming the amorphous layer of a-Si(H,X) on the substrate.

Further, there may also be introduced a gas such as $B_2H_6$ or others in order to effect also doping of impurities.

The amount of hydrogen atoms (H) or halogen atoms (X) incorporated in the amorphous layer in the photoconductive member formed in the present invention, or total amount (H+X) of both of these atoms, may be preferably 1 to 40 atomic %, more preferably 5 to 30 atomic %.

For controlling the amounts of hydrogen atoms (H) and/or halogen atoms (X) in the amorphous layer, the support temperature and/or the amounts of the starting materials for incorporation of hydrogen atoms (H) or halogen atoms (X) to be introduced into the deposition device system, the discharging power, and the like may be controlled.

For formation of the second layer region (A) containing the atoms (A) and the first layer region (O) containing oxygen atoms into the amorphous layer, a starting material for introduction of the atoms (A) and a starting material for introduction of oxygen atoms may be used, respectively, together with the starting material for formation of the amorphous layer as mentioned above during formation of the amorphous layer by the glow discharge method or the reactive sputtering method, and may be incorporated in the layer formed while controlling their amounts.

When the glow discharge method is to be employed for formation of the first layer region (O) and the layer region (A), respectively, constituting the amorphous layer, the starting material as the starting gas for formation of the layer region (O) may be constituted by adding a starting material for introduction of oxygen atoms and/or a starting material for introduction of the atoms (A) to the starting material selected as desired from those for formation of the amorphous layer as mentioned above. As such a starting material for introduction of oxygen atoms or the atoms (A), there may be employed most of gaseous or gasifiable substances containing oxygen atoms or atoms (A) as constituent atoms.

For example, for formation of the first layer region (O), there may be employed a mixture of a starting gas containing silicon atoms (Si) as constituent atoms, a starting gas containing oxygen atoms (O) as constituent atoms, and optionally a starting gas containing hydrogen atoms (H) and/or halogen atoms (X) as constituent atoms at a desired mixing ratio; a mixture of a starting gas containing silicon atoms (Si) as constituent atoms and a starting gas containing oxygen atoms and hydrogen atoms as constituent atoms also at a desired mixing ratio; or a mixture of a starting gas containing silicon atoms (Si) as constituent atoms and a starting gas containing the three atoms of silicon atoms (Si), oxygen atoms (O), and hydrogen atoms (H) as constituent atoms.

Alternatively, there may also be employed a mixture of a starting gas containing silicon atoms (Si) and hydrogen atoms (H) as constituent atoms and a starting gas containing oxygen atoms (O) as constituent atoms.

More specifically, there may be mentioned, for example, oxygen ($O_2$), ozone ($O_3$), nitrogen monooxide (NO), nitrogen dioxide ($NO_2$), dinitrogen monooxide ($N_2O$), dinitrogen trioxide ($N_2O_3$), dinitrogen tetroxide ($N_2O_4$), dinitrogen pentoxide ($N_2O_5$), nitrogen trioxide ($NO_3$), and lower siloxanes containing silicon atoms (Si), oxygen atoms (O), and hydrogen atoms (H) as constituent atoms such as disiloxane $H_3SiOSiH_3$, trisiloxane $H_3SiOSiH_2OSiH_3$, and the like.

When the second layer region (A) is formed by use of the glow discharge method, as the starting materials for introduction of the atoms (A) to be effectively used in the present invention, there may be included as example of starting materials for introduction of the group III atoms such as boron atoms, boron hydrides such as $B_2H_6$, $B_4H_{10}$, $B_5H_9$, $B_5H_{11}$, $B_6H_{10}$, $B_6H_{12}$, $B_6H_{14}$, and the like, and boron halides such as $BF_3$, $BCl_3$, $BBr_3$, and the like. In addition, there may also be included $AlCl_3$, $GaCl_3$, $Ga(CH_3)_3$, $InCl_3$, $TiCl_3$, and the like.

Illustrative of effective starting materials for introduction of the group V atoms such as phosphorus atoms are phosphorus hydrides such as $PH_3$, $P_2H_4$, and the like, and phosphorus halides such as $PH_4I$, $PF_3$, $PF_5$, $PCl_3$, $PCl_5$, $PBr_3$, $PBr_5$, $PI_3$, and the like. In addition, there may also be included $AsH_3$, $AsF_3$, $AsCl_3$, $AsBr_3$, $AsF_5$, $SbH_3$, $SbF_3$, $SbF_5$, $SbCl_3$, $SbCl_5$, $BiH_3$, $BiCl_3$, $BiBr_3$, and the like, as effective materials for introduction of the group V atoms.

The content of the atoms (A) to be introduced into the second layer region (A) may be freely controlled by controlling the gas flow rates and the gas flow rate ratio of the starting materials for introduction of atoms (A) to be flown into the deposition chamber, discharging power, the substrate temperature, the pressure in the deposition chamber, and others.

For formation of the first layer region (O) containing oxygen atoms according to the sputtering method, a single crystalline or polycrystalline Si wafer or $SiO_2$ wafer or a wafer containing Si and $SiO_2$ mixed therein may be employed as a target and sputtering of these wafers may be conducted in various gas atmospheres.

For example, when a Si wafer is employed as the target, a starting gas for introduction of oxygen atoms optionally together with a starting gas for introduction of hydrogen atoms and/or halogen atoms, which may optionally be diluted with a diluting gas, may be introduced into a deposition chamber for sputtering to form gas plasma of these gases, in which sputtering of the aforesaid Si wafer may be effected.

Alternatively, by use of separate targets of Si and $SiO_2$ or one sheet of a target containing Si and $SiO_2$ mixed therein, sputtering may be effected in an atmosphere of a diluting gas as a gas for sputtering or in a gas atmosphere containing at least hydrogen atoms (H) and/or halogen atoms (X) as constituent atoms. As the starting gas for introduction of oxygen atoms, there may be employed the starting gases shown as examples in the glow discharge method previously described also as effective gases in case of sputtering.

In the present invention, as the diluting gas to be used when the amorphous layer is formed according the glow discharge method or as the gas for sputtering to be used when it is formed according to the sputtering method, there may be mentioned the so called rare gases, such as He, Ne, Ar, etc., as preferable ones.

In the photoconductive member of the present invention, when the group V atoms are contained in the second layer region (A), there is contained in layer region (B), containing no group V atom (corresponding to the layer region 105 in FIG. 1) and provided on said layer region (A), a substance capable of controlling the conduction characteristics, such as, for example, the aforesaid group III atoms as a p-type impurity to impart to the region the p-type conduction, whereby the conduction characteristics of said layer region (B) can be freely controlled as desired.

In the present invention, the content of the substance for controlling the conduction characteristics contained in the layer region (B) may be determined suitably depending on the organic relationships among conduction characteristics required for said layer region (B), the characteristics of another layer region provided in direct contact with said layer region (B), and the characteristics at the contacted interface with said another layer region.

In the present invention, the content of the substance for controlling the conduction characteristics contained in the layer region (B) may preferably be 0.001 to 1000 atomic ppm, more preferably 0.05 to 500 atomic ppm, most preferably 0.1 to 200 atomic ppm.

Figure 2:
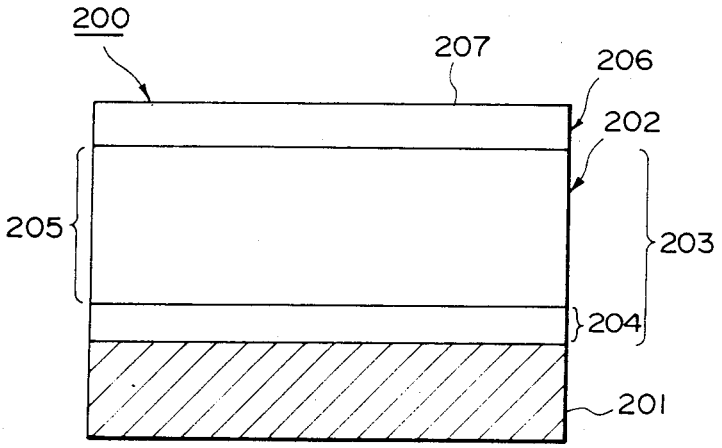

FIG. 2 is a schematic illustration of the layer constitution of another preferable embodiment of the photoconductive member of the present invention.

The photoconductive member 200 as shown in FIG. 2 is provided on a support 201 for photoconductive member with a first amorphous layer (I) 202 comprising a-Si(H,X) and exhibiting photoconductivity, and a second amorphous layer (II) 206, which is constituted of an amorphous material comprising silicon atoms and carbon atoms, optionally together with at least one of hydrogen atoms and halogen atoms, as constituent atoms [hereinafter written as "a-SiC(H,X)"], the second amorphous layer (II) 206 having a free surface 207.

The first amorphous layer (I) 202 in the photoconductive member 200 as shown in FIG. 2 is made to have the same layer constitution with the same materials as the amorphous layer 102 in the photoconductive member 100 as shown in FIG. 1.

The second amorphous layer (II) 206 is provided primarily for the purpose of accomplishing the objects of the present invention with respect to humidity resistance, continuous repeated use characteristics, dielectric strength, environmental characteristics in use and durability.

In the photoconductive member 200 as shown in FIG. 2, since each of the amorphous materials forming the first amorphous layer (I) 202 and the second amorphous layer (II) 206 have the common constituent of silicon atom, chemical and electric stabilities are sufficiently ensured at the laminated interface.

As a-SiC(H,X) constituting the second amorphous layer (II), there may be mentioned an amorphous material constituted of silicon atoms and carbon atoms (a-$Si_aC_{1-a}$, where $0<a<1$), an amorphous material constituted of silicon atoms, carbon atoms and hydrogen atoms [a-$(Si_bC_{1-b})_cH_{1-c}$, where $0<b, c<1$] and an amorphous material constituted of silicon atoms, carbon atoms, halogen atoms and, if desired, hydrogen atoms [a-$(Si_dC_{1-d})_e(X,H)_{1-e}$, where $0<d, e<1$] as effective materials.

Formation of the second amorphous layer (II) constituted of a-SiC(H,X) may be performed according to the glow discharge method, the sputtering method, the ion implantation method, the ion plating method, the electron beam method, etc. These preparation methods may be suitably selected depending on various factors such as the preparation conditions, the degree of the load for capital investment for installations, the production scale, the desirable characteristics required for the photoconductive member to be prepared, etc. For the advantages of relatively easy control of the preparation conditions for preparing photoconductive members having desired characteristics and easy introduction of silicon atoms and carbon atoms, optionally together with hydrogen atoms and halogen atoms, into the second amorphous layer (II) to be prepared, there may preferably be employed the glow discharge method or the sputtering method.

Further, in the present invention, the second amorphous layer (II) may be formed by using the glow discharge method and the sputtering method in combination in the same device system.

For formation of the second amorphous layer (II) according to the glow discharge method, starting gases for formation of a-SiC(H,X), optionally mixed at a predetermined mixing ratio with diluting gas, may be introduced into a deposition chamber for vacuum deposition in which a support is placed, and the gas introduced is made into a gas plasma by excitation of glow discharging, thereby depositing a-SiC(H,X) on the first amorphous layer (I) which has already been formed on the aforesaid support.

As the starting gases for formation of a-SiC(H,X) to be used in the present invention, it is possible to use most of gaseous substances or gasified gasifiable substances containing at least one of Si, C, H, and X as constituent atoms.

In the case when a starting gas having Si as constituent atoms as one of Si, C, H, and X is employed, there may be employed, for example, a mixture of a starting gas containing Si as constituent atom, a starting gas containing C as constituent atom, and a starting gas containing H or X as constituent atom at a desired mixing ratio, or alternatively a mixture of a starting gas containing Si as constituent atoms with a starting gas containing C and H or X also at a desired mixing ratio, or a mixture of a starting gas containing Si as constituent atoms with a gas containing three atoms of Si, C and H or of Si, C and X as constituent atoms.

Alternatively, it is also possible to use a mixture of a starting gas containing Si and H or X as constituent atoms with a starting gas containing C as a constituent atom.

In the present invention, the starting gases effectively used for formation of the second amorphous layer (II) may include hydrogenated silicon gases containing Si and H as constituent atoms such as silanes (e.g. $SiH_4$, $Si_2H_6$, $Si_3H_8$, $Si_4H_{10}$, etc.), compounds containing C and H as constituent atoms such as saturated hydrocarbons having 1 to 5 carbon atoms, ethylenic hydrocarbons having 2 to 5 carbon atoms and acetylenic hydrocarbons having 2 to 4 carbon atoms.

More specifically, there may be included, as saturated hydrocarbons, methane ($CH_4$), ethane ($C_2H_6$), propane ($C_3H_8$), n-butane (n-$C_4H_{10}$), pentane ($C_5H_{12}$); as ethylenic hydrocarbons, ethylene ($C_2H_4$), propylene ($C_3H_6$), butene-1 ($C_4H_8$), butene-2 ($C_4H_8$), isobutylene ($C_4H_8$), pentene ($C_5H_{10}$); as acetylenic hydrocarbons, acetylene ($C_2H_2$), methyl acetylene ($C_3H_4$), butyne ($C_4H_6$); and the like.

As the starting gas containing Si, C and H as constituent atoms, there may be mentioned alkyl silanes such as $Si(CH_3)_4$, $Si(C_2H_5)_4$, and the like. In addition to these starting gases, it is also possible as a matter of course to use $H_2$ as effective starting gas for introduction of H.

In the present invention, preferable halogen atoms (X) to be contained in the second amorphous layer (II) are F, Cl, Br and I. Particularly, F and Cl are preferred.

Incorporating of hydrogen atoms into the second amorphous layer (II) is convenient from aspect of production cost, because a part of starting gas species can be made common in forming continuously layers together with the first amorphous layer (I).

In the present invention, as the starting gas which can be used effectively for introduction of halogen atoms (X) in formation of the second amorphous layer (II), there may be mentioned gaseous substances under conditions of normal temperature and normal pressure or readily gasifiable substances.

Such starting gases for introduction of halogen atoms may include single halogen substances, hydrogen halides, interhalogen compounds, silicon halides, halogen-substituted hydrogenated silicons, and the like.

More specifically, there may be mentioned, as single halogen substances, halogen gases such as of fluorine, chlorine, bromine, and iodine; as hydrogen halides, HF, HI, HCl, HBr; as interhalogen compounds, BrF, ClF, $ClF_3$, $ClF_5$, $BrF_5$, $BrF_3$, $IF_7$, $IF_5$, ICl, IBr; as silicon halides, $SiF_4$, $Si_2F_6$, $SiCl_4$, $SiCl_3Br$, $SiCl_2Br_2$, $SiClBr_3$, $SiCl_3I$, $SiBr_4$, as halogen-substituted hydrogenated silicon, $SiH_2F_2$, $SiH_2Cl_2$, $SiHCl_3$, $SiH_3Cl$, $SiH_2Br_2$, $SiH_3Br$, $SiHBr_3$; and so on.

In addition to these materials, there may also be employed halogen-substituted paraffinic hydrocarbons such as $CCl_4$, $CHF_3$, $CH_2F_2$, $CH_3F$, $CH_3Cl$, $CH_3Br$, $CH_3I$, $C_2H_5Cl$, and the like, fluorinated sulfur compounds such as $SF_4$, $SF_6$, and the like, halogen-containing alkyl silanes such as $SiCl(CH_3)_3$, $SiCl_2(CH_3)_2$, $SiCl_3CH_3$, and the like, as effective materials.

For information of the second amorphous layer (II) according to the sputtering method, a single crystalline or polycrystalline Si wafer or C wafer or a wafer containing Si and C mixed therein is used as a target and subjected to sputtering in an atmosphere of various gases.

For example, when a Si wafer is used as target, a starting gas for introducing at least C, which may be diluted with a diluting gas, if desired, is introduced into a deposition chamber for sputtering to form a gas plasma therein and effect sputtering of said Si wafer.

Alternatively, Si and C as separate targets or one sheet target of a mixture of Si and C can be used and sputtering is effected in a gas atmosphere containing, if necessary, at least hydrogen atoms or halogen atoms.

As the starting gas for introduction of C or for introduction of H or X, there may be employed those as mentioned in the glow discharge as described above as effective gases also in case of sputtering.

In the present invention, as the diluting gas to be used in forming the second amorphous layer (II) by the glow discharge method or the sputtering method, there may preferably employed so-called rare gases such as He, Ne, Ar, and the like.

The second amorphous layer (II) in the present invention should be carefully formed so that the required characteristics may be give exactly as desired.

That is, a substance containing as constituent atoms Si, C and, if necessary, H and/or X can take various forms from crystalline to amorphous, electrical properties from conductive through semi-conductive to insulating and photoconductive properties from photoconductive to non-photoconductive depending on the preparation conditions. Therefore, in the present invention, the preparation conditions are strictly selected as desired so that there may be formed a-SiC(H,X) having desired characteristics depending on the purpose.

For example, when the second amorphous layer (II) is to be provided primarily for the purpose of improvement of dielectric strength, a-SiC(H,X) is prepared as an amorphous material having marked electric insulating behaviours under the usage conditions.

Alternatively, when the primary purpose for provision of the second amorphous layer (II) is improvement of continuous repeated use characteristics or environmental use characteristics, the degree of the above electric insulating property may be alleviated to some extent and a-SiC(H,X) may be prepared as an amorphous material having sensitivity to some extent to the light irradiated.

In forming the second amorphous layer (II) comprising a-SiC(H,X) on the surface of the first amorphous layer (I), the support temperature during layer formation is an important factor having influences on the structure and the characteristics of the layer to be formed, and it is desired in the present invention to control severely the support temperature during layer formation so that a-SiC(H,X) having intended characteristics may be prepared as desired.

As the support temperature in forming the second amorphous layer (II) for accomplishing effectively the objects in the present invention, there may be selected suitably the optimum temperature range in conformity with the method for forming the second amorphous layer (II) in carrying out formation of the second amorphous layer (II).

When the second amorphous layer (II) is to be formed of a-$Si_aC_{1-a}$, the support temperature may preferably be 20° to 300° C., more preferably 20° to 250° C.

When the second amorphous layer (II) is to be formed of a-$(Si_bC_{1-b})_cH_{1-c}$ or a-$(Si_dC_{1-d})_3(X,H)_{1-e}$, the support temperature may preferably be 50° to 350° C., more preferably 100° to 250° C.

For formation of the second amorphous layer (II), the glow discharge method or the sputtering method may advantageously adopted, because severe control of the composition ratio of atoms constituting the layer or control of layer thickness can be conducted with relative ease as compared with other methods. In a case when the second amorphous layer (II) is to be formed according to these layer forming methods, the discharging power, the gas pressure during layer formation is one of important factors influencing the characteristics of a-SiC(H,X) to be prepared, similarly as the aforesaid support temperature.

The discharging power condition for preparing effectively a-$Si_aC_{1-a}$ having characteristics for accomplishing the objects of the present invention with good productivity may preferably be 50 W to 250 W, most preferably 80 W to 150 W.

The discharging power conditions, in case of a-$(Si_bC_{1-b})_cH_{1-c}$ or a-$(Si_dC_{1-d})_e(H,X)_{1-e}$, may preferably be 10 to 300 W, more preferably 20 to 200 W.

The gas pressure in a deposition chamber may preferably be 0.01 to 5 Torr, more preferably 0.01 to 1 Torr, most preferably 0.1 to 0.5 Torr.

In the present invention, the above numerical ranges may be mentioned as preferable numerical ranges for the support temperature, discharging power, etc. However, these factors for layer formation should not determined separately independently of each other, but it is desirable that the optimum values of respective layer forming factors should be determined based on mutual organic relationships so that a second amorphous layer (II) comprising a-SiC(H,X) having desired characteristics may be formed.

The contents of carbon atoms and hydrogen atoms in the second amorphous layer (II) in the photoconductive member of the present invention are the second important factor for obtaining the desired characteristics to accomplish the objects of the present invention, similarly as the conditions for preparation of the second amorphous layer (II).

The content of carbon atoms contained in the second amorphous layer (II) in the present invention, when it is constituted of a-$Si_aC_{1-a}$, may be generally $1\times10^{-3}$ to 90 atomic %, preferably 1 to 80 atomic %, most preferably 10 to 75 atomic %. That is, in terms of the aforesaid representation a in the formula a-$Si_aC_{1-a}$, a may be generally 0.1 to 0.99999, preferably 0.2 to 0.99, most preferably 0.25 to 0.9.

When the second amorphous layer (II) is constituted of a-$(Si_bC_{1-b})_cH_{1-c}$, the content of carbon atoms contained in said layer (II) may be generally $1\times10^{-3}$ to 90 atomic %, preferably 1 to 90 atomic %, most preferably 10 to 80 atomic %. The content of hydrogen atoms may be generally 1 to 40 atomic %, preferably 2 to 35 atomic %, most preferably 5 to 30 atomic %. A photoconductive member formed to have a hydrogen atom content within these ranges is sufficiently applicable as an excellent one in practical applications.

That is, in terms of the representation by a-$(Si_bC_{1-b})_cH_{1-c}$, b may be generally at 0.1 to 0.99999, preferably 0.1 to 0.99, most preferably 0.15 to 0.9, and c generally 0.6 to 0.99, preferably 0.65 to 0.98, most preferably 0.7 to 0.95.

When the second amorphous layer (II) is constituted of a-$(Si_dC_{1-d})_3(H,X)_{1-e}$, the content of carbon atoms contained in said layer (II) may be generally $1\times10^{-3}$ to 90 atomic %, preferably 1 to 90 atomic %, most preferably 10 to 80 atomic %. The content of halogen atoms may be generally 1 to 20 atomic %, preferably 1 to 18 atomic %, most preferably 2 to 15 atomic %. A photoconductive member formed to have a halogen atom content with these ranges is sufficiently applicable as an excellent one in practical applications. The content of hydrogen atoms to be optionally contained may be generally up to 19 atomic %, preferably 13 atomic % or less. That is, in terms of the representation by a-$(Si_dC_{1-}$ $d)_e(H,X)_{1-e}$, d may be generally 0.1 to 0.99999, preferably 0.1 to 0.99, most preferably 0.15 to 0.9, and e generally 0.8 to 0.99, preferably 0.82 to 0.99, most preferably 0.85 to 0.98.

The range of the numerical value of layer thickness of the second amorphous layer (II) is one of important factors for accomplishing effectively the objects of the present invention.

The range of the numerical value of layer thickness of the second amorphous layer (II) should desirably be determined depending on the intended purpose so as to effectively accomplish the objects of the present invention.

The layer thickness of the second amorphous layer (II) is required to be determined as desired suitably with due considerations about the relationships with the contents of carbon atoms, hydrogen atoms or halogen atoms, the layer thickness of the first amorphous layer (I), as well as other organic relationships with the characteristics required for respective layer regions. In addition, it is also desirable to have considerations from economical point of view such as productivity or capability of mass production.

The second amorphous layer (II) in the present invention is desired to have a layer thickness generally of 0.003 to 30μ, preferably 0.004 to 20μ, most preferably 0.005 to 10μ.

Figure 12:
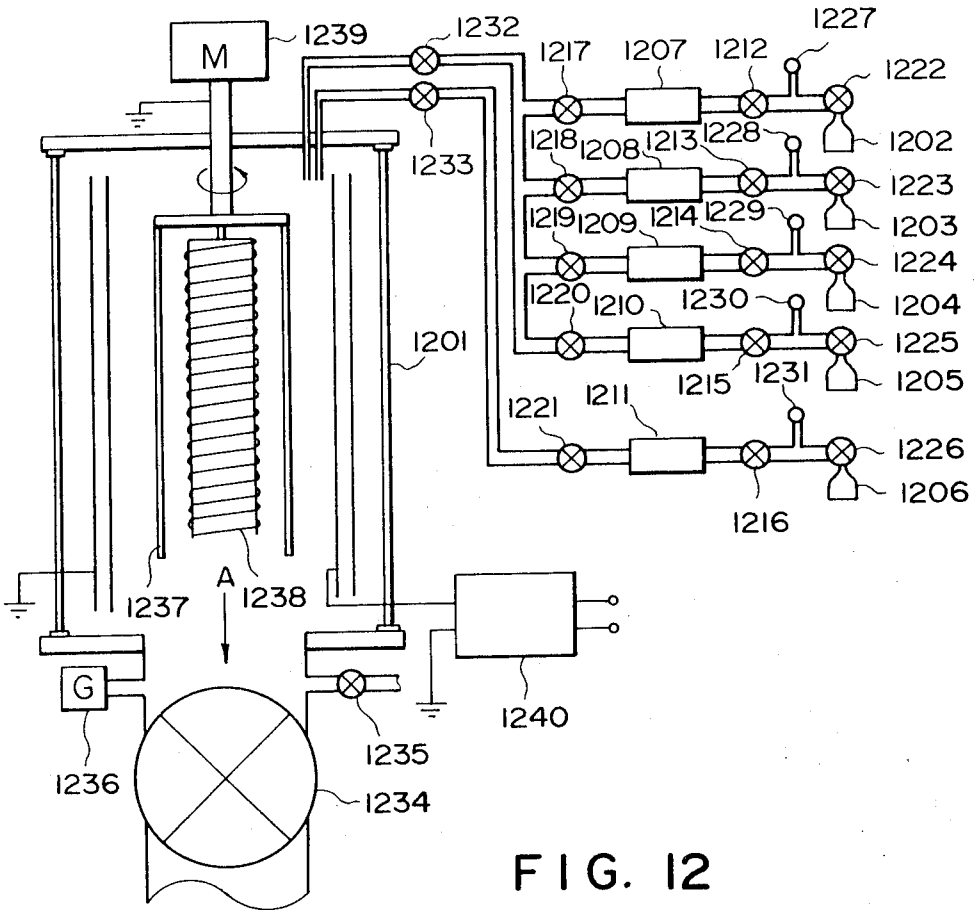
FIG. 12 and FIG. 13 show schematic charts for illustration of the devices used for preparation of the photoconductive members of the present invention, respectively.

FIG. 12 shows a device for producing a photoconductive member according to the present invention.

In the gas bombs 1202, 1203, 1204, 1205, and 1206 there are hermetically contained starting gases for formation of respective layers of the present invention. For example, 1202 is a bomb containing $SiH_4$ gas diluted with He (purity: 99.999% hereinafter abbreviated as "$SiH_4$/He"), 1203 is bomb containing $B_2H_6$ gas diluted with He (purity: 99.999% hereinafter abbreviated as "$B_2H_6$/He"), 1204 is bomb containing $Si_2H_6$ gas diluted with He (purity: 99.999% hereinafter abbreviated as "$Si_2H_6$/He), 1205 is a bomb containing NO gas (purity: 99.999%), and 1206 is a bomb containing $SiF_4$ gas diluted with He (purity: 99.999% hereinafter abbreviated as $SiF_4$/He).

For allowing these gases to flow into the reaction chamber 1201, on confirmation of the valves 1222–1226 of the gas bombs 1202–1206 and the leak valve 1235 to be closed, and the inflow valves 1212–1216, the outflow valves 1217–1221, and the auxiliary valves 1232 and 1233 to be open, the main valve 1234 is first opened to evacuate the reaction chamber 1201 and the gas pipelines. As the next step, when the reading on the vacuum indicator 1236 becomes about $5\times10^{-6}$ Torr, the auxiliary valves 1232 and 1233 and the outflow valves 1217–1221 are closed.

Referring now to an example of forming a second layer region (A) constituting an amorphous layer on a substrate cylinder 1237, $SiH_4$/He gas from the gas bomb 1202 and $B_2H_6$/He gas from the gas bomb 1203 are permitted to flow into the mass-flow controllers 1207 and 1208 by opening the valves 1222 and 1223 to control the pressures at the outlet pressure gauges 1227 and 1228 to 1 Kg/cm$^2$ and opening gradually the inflow valves 1212 and 1213. Subsequently, the outflow valves 1217 and 1218 and the auxiliary valve 1232 are gradually opened to permit respective gases to flow into the reaction chamber 1201. The outflow valves 1217 and 1218 are controlled so that the relative flow rate ratio of $SiH_4$/He gas to $B_2H_6$/He gas may have the desired value and opening of the main valve 1234 is also controlled while watching the reading on the vacuum indicator 1236 so that the pressure in the reaction chamber may reach a desired value. And, after confirming that the temperature of the substrate cylinder 1237 is set at 50°–400° C. by the heater 1238, the power source 1240 is set at a desired power to excite glow discharge in the reaction chamber 1201, thereby forming a layer region (A) on the support.

During formation of the layer region (A), a desired amount of oxygen atoms can be incorporated into the layer region (A), by introducing NO gas from the bomb 1205 into the reaction chamber 1201, while controlling the flow rate in accordance with a previously designed change ratio curve.

At the stage when the layer region (A) is formed to a desired thickness, introduction of $B_2H_6$/He gas from the bomb 1203 into the reaction chamber 1201 is shut down, while maintaining continuously glow discharging, whereby there is formed a first layer region (O) containing none of the group III and V atoms (in this case boron atoms) but containing oxygen atoms to a desired thickness on the layer region (A).

All the outflow valves other than those for gases necessary for formation of respective layers are of course closed, and during formation of respective layers, in order to avoid retention of the gas used in the preceeding layer in the reaction chamber 1201 and pipelines from the outflow valves 1217–1221 to the reaction chamber 1201, there may be conducted the procedure, comprising once evacuating to a high vacuum the system by closing the outflow valves 1217–1221 and opening the auxiliary valves 1232 and 1233 with full opening of the main valve 1234, if necessary.

During formation of the layer, the substrate cylinder 1237 may be rotated at a constant speed by means of a motor 1239 in order to effect uniform layer formation.

Figure 13:
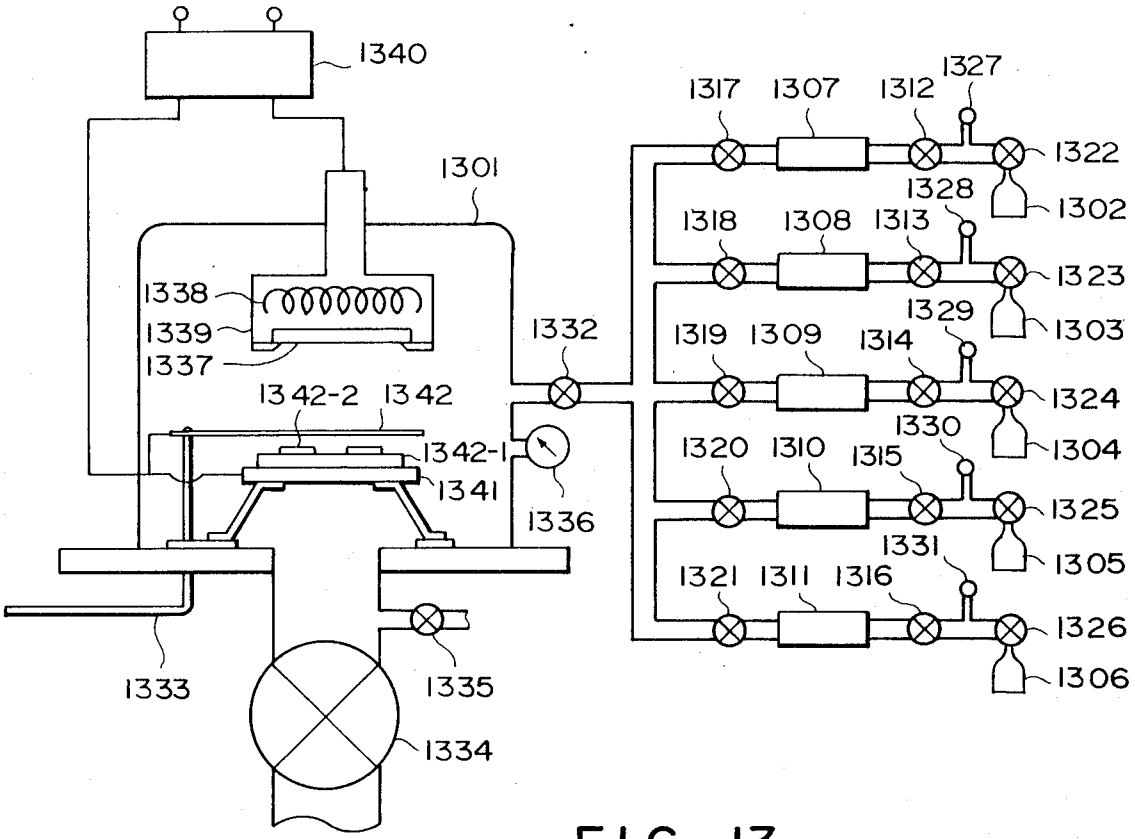

In FIG. 13 shows another example of a device for producing a photoconductive member according to the present invention.

In the gas bombs 1302, 1303, 1304, 1305, and 1306 there are hermetically contained starting gases for formation of respective layers of the present invention. For example, 1302 is a $SiH_4$/He gas bomb, 1303 is a $B_2H_6$/He gas bomb, 1304 is a Ar gas bomb (purity: 99.99%), 1305 is a NO gas bomb (purity: 99.999%), and 1306 is a $SiF_4$/He gas bomb.

For allowing these gases to flow into the reaction chamber 1301, on confirmation of the valves 1322–1326 of the gas bombs 1302–1306 and the leak valve 1335 to be closed, and the inflow valves 1312–1316, the outflow valves 1317–1321 and the auxiliary valve 1332 to be open, the main valve 1334 is first opened to evacuate the reaction chamber 1301 and the gas pipelines. As the next step, when the reading on the vacuum indicator 1336 becomes about $5\times10^{-6}$ Torr, the auxiliary valve 1332, the inflow valves 1312–1316, and the outflow valves 1317–1321 are closed.

Then, the valves of the gas pipelines connected to the bombs of the gases to be introduced into the reaction chamber 1301 are operated as scheduled to introduce the desired gases into the reaction chamber 1301.

In the following, one example of preparing a photoconductive member having a first amorphous layer (I) and a second amorphous layer (II) on said layer (I) having the same layer constitution as shown in FIG. 2 is to be briefly described.

$SiH_4$/He gas from the gas bomb 1302, $B_2H_6$/He gas from the gas bomb 1303, and NO gas from the gas bomb 1305 are permitted to flow into the mass-flow controllers 1307, 1308, 1310 by opening the valves 1322, 1323 and 1325 by controlling the pressures at the outlet pressure gauges 1327, 1328 and 1330 to 1 Kg/cm$^2$ and opening gradually the inflow valves 1312, 1313 and 1315. Subsequently, the outflow valves 1317, 1318, 1320 and the auxiliary valve 1332 are gradually opened to permit respective gases to flow into the reaction chamber 1301. The outflow valves 1317 and 1318 are controlled so that the relative flow rate ratios between $SiF_4$/He, $B_2H_6$/He and NO gases may have the desired values and opening of the main valve 1334 is also controlled while watching the reading on the vacuum indicator 1336 so that the pressure in the reaction chamber may reach a desired value. And, after confirming that the temperature of the substrate 1337 is set at 50°–400° C. by the heater 1338, the power source 1340 is set at a desired power to excite glow discharge in the reaction chamber 1301, while simultaneously performing the operation to change gradually the flow rates of $B_2H_6$/He gas and NO gas in accordance with a previously designed change ratio curve by changing the valves 1318 and 1320 gradually by the manual method or by means of an externally driven motor, thereby controlling the content of boron atoms in the layer, thereby forming a layer region ($t_1$-$t_B$).

At the time when the layer region ($t_1$-$t_B$) has been formed, the valves 1318 and 1320 are completely closed, and the layer formation is carried out thereafter only with the use of $SiH_4$/He gas, and consequently the layer region ($t_T$-$t_1$) is formed at a desired layer thickness on the layer region ($t_1$-$t_B$) to complete formation of the first amorphous layer (I).

After the amorphous layer (I) has been formed to a desired layer thickness with desired depth profiles of boron atoms and oxygen atoms to be contained therein, the outflow valve 1317 is once completely closed, with intermission of discharging.

As the species of the starting gas to be employed for formation of the amorphous layer (I), other than $SiH_4$ gas, $Si_2H_6$ gas is particularly effective for improvement of the layer formation speed.

When halogen atoms are to be incorporated in the first amorphous layer (I), other gases such as $SiF_4$/He are further added to the above gases and charged into the reaction chamber 1301.

Formation of the second layer (II) on the first amorphous layer (I) may be carried out, for example, as follows. First, the shutter 1342 is opened by a handle 1333. All the gas supplying valves are once closed, the reaction chamber 1301 is evacuated by full opening of the main valve 1334.

On the electrode 1341 on which high power is to be applied, there are provided targets of a high purity silicon wafer 1342-1 and a high purity graphite wafer 1342-2 with a desired area ratio. From the gas bomb 1305, Ar gas is introduced into the reaction chamber 1301, and the main valve 1334 is controlled so that the inner pressure in the reaction chamber 1301 may become 0.05 to 1 Torr. The high voltage power source 1340 is turned on to effect sputtering on the aforesaid target, whereby the second amorphous layer (II) can be formed on the first amorphous layer (I).

The content of the carbon atoms to be contained in the second amorphous layer (II) can be controlled as desired by controlling the area ratio of the silicon wafer to the graphite wafer, or the mixing ratio of the silicon powders to the graphite powders during preparation of the target.

The photoconductive member of the present invention designed to have layer constitution as described above can overcome all of the problems as mentioned above and exhibit very excellent electrical, optical, photoconductive characteristics, dielectric strength, as well as good environmental characteristics in use.

In particular, when it is applied as an image forming member for electrophotography, it is excellent in charge retentivity in charging treatment without any influence of residual potential on image formation at all, being stable in its electrical properties with high sensitivity and having high SN ratio as well as excellent light fatigue resistance and repeated usage characteristics, whereby it is possible obtain repeatedly images of high quality with high concentration, clear halftone and high resolution.

Also, in the photoconductive member of the present invention, the amorphous layer formed on the support is itself tough and markedly excellent in adhesion to the support, and therefore it can be used continuously for a long time repeatedly at a high speed.

EXAMPLE 1

Figure 14:
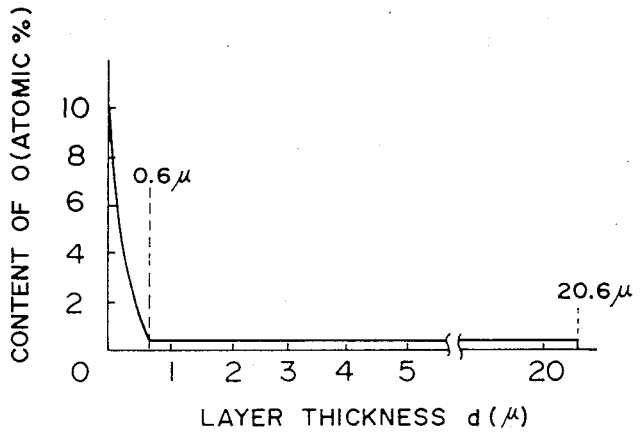
FIG. 14 through FIG. 17 show schematic charts for illustration of the depth profiles of oxygen atoms in the layer region (O) in Examples of this invention.

By means of the preparation device as shown in FIG. 12, an amorphous layer having an oxygen depth profile as shown in FIG. 14 was formed on an Al cylinder under the conditions as indicated in Table 1A.

The image forming member thus obtained was set in a charging-exposure-developing device, subjected to corona charging at ⊕5.0 kV for 0.2 sec, followed immediately by irradiation of a light image. As the light source, a tungsten lamp was employed and irradiation was effected at a dose of 1.5 lux.sec. using a transmissive type test chart.

Immediately thereafter, a negatively charged developer (containing toner and carrier) was cascaded onto the surface of the image forming member, whereby a good toner image was obtained thereon. When the toner image on the member was transferred onto a transfer paper subjected to corona charging at ⊕5.0 kV, there was obtained a clear image with high density which was excellent in resolving power and good in gradation reproduction.

TABLE 1A

| | Gases employed | Flow rate (SCCM) | Flow rate ratio | Discharging power (W/cm$^2$) | Layer formation speed (Å/sec) | Layer thickness (μ) |
|---|---|---|---|---|---|---|
| First layer region | $SiH_4$/He = 0.5<br>NO<br>$B_2H_6$/He = $10^{-3}$ | $SiH_4$ = 200 | NO/$SiH_4$ = $1 \times 10^{-1} \sim 1 \times 10^{-4}$<br>$B_2H_6$/$SiH_4$ = $4 \times 10^{-3}$ | 0.18 | 15 | 0.6 |
| Second layer region | $SiH_4$/He = 0.5<br>NO | $SiH_4$ = 200 | NO/$SiH_4$ = $1 \times 10^{-4}$ | 0.18 | 15 | 20 |

TABLE 1A-continued

| Gases employed | Flow rate (SCCM) | Flow rate ratio | Discharging power ($W/cm^2$) | Layer formation speed (Å/sec) | Layer thickness ($\mu$) |
|---|---|---|---|---|---|
| Substrate temperature | | | 250° C. | | |
| Discharging frequency | | | 13.56 MHz | | |
| Inner pressure during reaction | | | 0.5 Torr | | |

EXAMPLE 2

Figure 15:
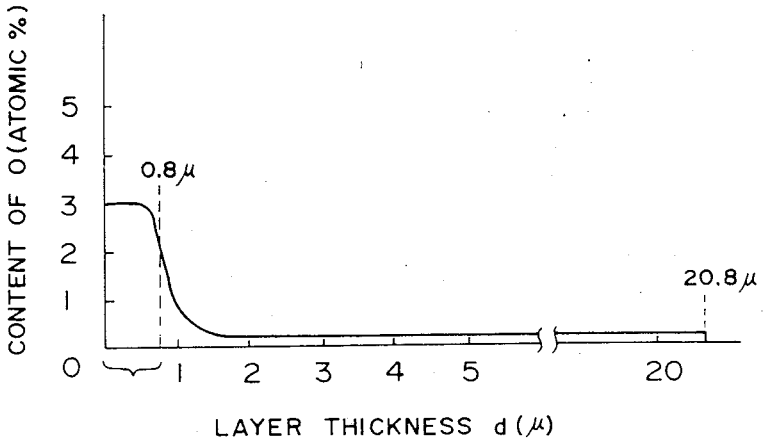

By means of the preparation device as shown in FIG. 12, an amorphous layer having an oxygen depth profile as shown in FIG. 15 was formed under the conditions as indicated in Table 2A.

Other conditions were the same as in Example 1.

Using the thus obtained image forming member, images were formed on transfer papers according to the same procedure and under the same conditions as in Example 1 to obtain a very clear image quality.

TABLE 2A

| | Gases employed | Flow rate (SCCM) | Flow rate ratio | Discharging power ($W/cm^2$) | Layer Formation speed (Å/sec) | Layer thickness ($\mu$) |
|---|---|---|---|---|---|---|
| First layer region | $SiH_4/He = 0.5$<br>NO<br>$B_2H_6/He = 10^{-3}$ | $SiH_4 =$ 200 | $NO/SiH_4 = 3 \times 10^{-2} \sim 2 \times 10^{-2}$<br>$B_2H_6/SiH_4 = 2 \times 10^{-3}$ | 0.18 | 15 | 0.8 |
| Second layer region | $SiH_4/He = 0.5$<br>NO | $SiH_4 =$ 200 | $NO/SiH_4 = 2 \times 10^{-2} \sim 7 \times 10^{-4}$ | 0.18 | 15 | 20 |

EXAMPLE 3

Figure 16:
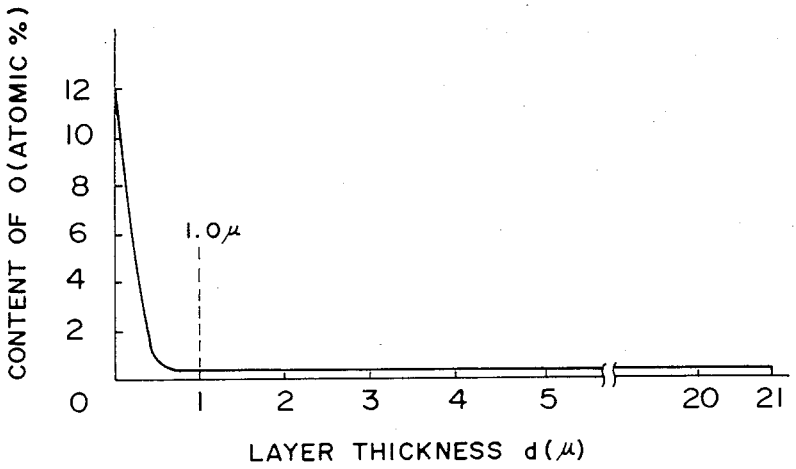

By means of the preparation device as shown in FIG. 12, an amorphous layer having an oxygen depth profile as shown in FIG. 16 was formed under the conditions as indicated in Table 3A.

Other conditions were the same as in Example 1.

Using the thus obtained image forming member, images were formed on transfer papers according to the same procedure and under the same conditions as in Example 1 to obtain a very clear image quality.

TABLE 3A

| | Gases employed | Flow rate (SCCM) | Flow rate ratio | Discharging power ($W/cm^2$) | Layer formation speed (Å/sec) | Layer thickness ($\mu$) |
|---|---|---|---|---|---|---|
| First layer region | $SiH_4/He = 0.5$<br>NO<br>$B_2H_6/He = 10^{-3}$ | $SiH_4 =$ 200 | $NO/SiH_4 = 1.2 \times 10^{-1} \sim 3 \times 10^{-4}$<br>$B_2H_6/SiH_4 = 1.5 \times 10^{-3}$ | 0.18 | 15 | 1.0 |
| Second layer region | $SiH_4/He = 0.5$<br>NO | $SiH_4 =$ 200 | $NO/SiH_4 = 3 \times 10^{-4}$ | 0.18 | 15 | 20 |

EXAMPLE 4

Layer formations were conducted in entirely the same manner as in Example 1 except that the content ratio of boron atoms in the first layer region was varied by varying the flow rate ratio of $B_2H_6$ to $SiH_4$ during formation of the first layer region. As the result, there were obtained the results as shown in Table 4A.

TABLE 4A

| B/Si (Content ratio) | $5 \times 10^{-4}$ | $1 \times 10^{-3}$ | $3 \times 10^{-3}$ | $6 \times 10^{-3}$ | $1 \times 10^{-2}$ |
|---|---|---|---|---|---|
| Evaluation of the image quality | ○ | ◎ | ◎ | ◎ | ○ |

◎: Very good
○ : Good

EXAMPLE 5

Layer formations were conducted in entirely the same manner as in Example 2 except that the layer thickness of the first layer region was varied as shown in Table 5A to obtain the results as shown in Table 5A.

TABLE 5A

| First layer region (thickness) ($\mu$): | 0.05 | 0.1 | 0.3 | 0.5 | 2 | 5 | 7 |
|---|---|---|---|---|---|---|---|
| evaluation of the image quality. | ○ | ◎ | ◎ | ◎ | ◎ | ○ | Δ |

◎: Very Good
○ : Good
Δ: Practically useful

EXAMPLE 6

Layer formations were conducted in entirely the same manner as in Example 1 except that the methods for forming the first and the second layer regions were changed as indicated in Table 6A, and evaluation of the image quality was performed similarly as in Example 1 to obtain good results.

TABLE 6A

| | Gases employed | Flow rate (SCCM) | Flow rate ratio | Discharging power (W/cm$^2$) | Layer formation speed (Å/sec) | Layer thickness (μ) |
|---|---|---|---|---|---|---|
| First layer region | $SiH_4/He = 0.5$<br>$SiF_4/He = 0.5$<br>NO<br>$B_2H_6/He = 10^{-3}$ | $SiH_4 + SiF_4 = 200$ | $NO/SiH_4 + SiF_4 = 1 \times 10^{-1} \sim 1 \times 10^{-4}$<br>$B_2H_6/SiH_4 + SiF_4 = 4 \times 10^{-3}$ | 0.18 | 15 | 0.6 |
| Second layer region | $SiH_4/He = 0.5$<br>$SiF_4/He = 0.5$<br>NO | $SiH_4 + SiF_4 = 200$ | $NO/SiH_4 + SiF_4 = 1 \times 10^{-4}$ | 0.18 | 15 | 20 |

EXAMPLE 7

Figure 17:
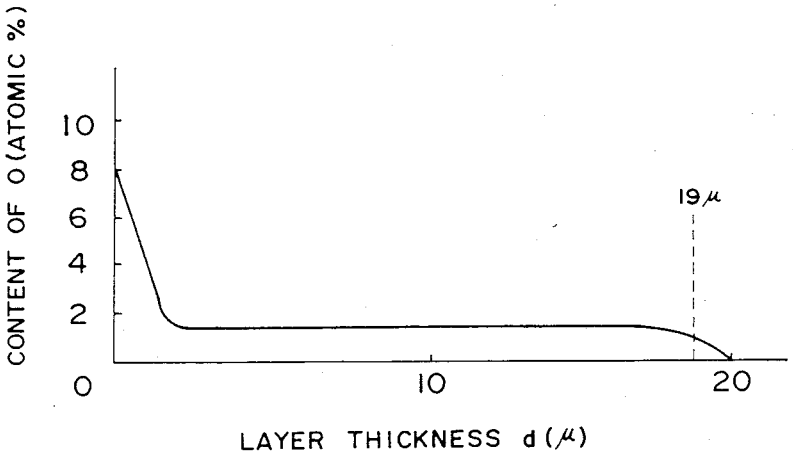

By means of the preparation device as shown in FIG. 12, an amorphous layer having an oxygen depth profile as shown in FIG. 17 was formed on an Al cylinder under the conditions as indicated in Table 7A.

TABLE 7A

| | Gas employed | Flow rate (SCCM) | Flow rate ratio | Discharging power (W/cm$^2$) | Layer formation speed (Å/sec) | Layer thickness (μ) |
|---|---|---|---|---|---|---|
| First layer region | $SiH_4/He = 0.5$<br>NO<br>$B_2H_6/He = 10^{-3}$ | $SiH_4 = 200$ | $NO/SiH_4 = 8 \times 10^{-2} \sim 1 \times 10^{-2}$<br>$B_2H_6/SiH_4 = 8 \times 10^{-5}$ | 0.18 | 15 | 19 |
| Second layer region | $SiH_4/He = 0.5$<br>NO | $SiH_4 = 200$ | $NO/SiH_4 = 1 \times 10^{-2} \sim 1 \times 10^{-4}$ | 0.18 | 15 | 1 |

EXAMPLE 8

By means of the preparation device as shown in FIG. 13, there was prepared an image forming member having oxygen depth profiles in the first and the second layer regions as shown in FIG. 14 under the conditions as indicated in Table 1B.

TABLE 1B

| Gases employed | Flow rate (SCCM) | Flow rate ratio (Area ratio) | Discharging Power (W/cm$^2$) | Layer formation speed (Å/sec) | Layer thickness (μ) |
|---|---|---|---|---|---|
| | | Amorphous layer (I) | | | |
| First layer region | | | | | |
| $SiH_4/HE = 0.5$<br>NO<br>$B_2H_6/HE = 10^{-3}$ | $SiH_4 = 200$ | $NO/SiH_4 = 1 \times 10^{-1} \sim 1 \times 10^{-1}$<br>$B_2H_6/SiH_4 = 4 \times 10^{-3}$ | 0.18 | 15 | 0.6 |
| Second layer region | | | | | |
| $SiH_4/He = 0.5$<br>NO | $SiH_4 = 200$ | $NO/SiH_4 = 2 \times 10^{-4}$ | 0.18 | 15 | 20 |
| | | Amorphous layer (II) | | | |
| Ar | 200 | Si wafer:Graphite 1.5:8.5 | 0.3 | 2 | 0.3 |

Substrate temperature: 250° C.
Discharging frequency: 13.56 MHz
Inner pressure during reaction: 0.5 Torr

EXAMPLE 9

By means of the preparation device as shown in FIG. 13, an image forming member having oxygen depth profiles in the first and the second layer regions in FIG.

The image forming member thus obtained was set in a charging-exposure-developing device, subjected to corona charging at ⊕5.0 kV for 0.2 sec, followed immediately by irradiation of a light image. As the light source, a tungsten lamp was employed and irradiation was effected at a dose of 1.5 lux.sec. using a transmissive type test chart.

Immediately thereafter, a negatively charged developer (containing toner and carrier) was cascaded onto the surface of the image forming member, whereby a good toner image was obtained thereon. When the toner image on the member was transferred onto a transfer paper subjected to corona charging at ⊕5.0 kV, there was obtained a clear image with high density which was excellent in resolving power and good in gradation reproduction.

15 was formed under the conditions as indicated in Table 2B.

Other conditions were the same as in Example 8.

Using the thus obtained image forming member, images were formed on transfer papers according to the same procedure and under the same conditions as in Example 8 to obtain a very clear image quality.

TABLE 2B

| Gases employed | Flow rate (SCCM) | Flow rate ratio (Area ratio) | Discharging power (W/cm$^2$) | Layer formation speed (Å/sec) | Layer thickness (μ) |
|---|---|---|---|---|---|
| | | Amorphous layer (I) | | | |
| First layer region | | | | | |
| $SiH_4$/He = 0.5<br>NO<br>$B_2H_6$/He = $10^{-3}$ | $SiH_4$ = 200 | NO/$SiH_4$ = $3 \times 10^{-2} \sim 2 \times 10^{-2}$<br>$B_2H_6$/$SiH_4$ = $2 \times 10^{-3}$ | 0.18 | 15 | 0.8 |
| Second layer region | | | | | |
| $SiH_4$/He = 0.5<br>NO | $SiH_4$ = 200 | NO/$SiH_4$ = $2 \times 10^{-2} \sim 7 \times 10^{-4}$ | 0.18 | 15 | 20 |
| | | Amorphous layer (II) | | | |
| Ar | 200 | Si wafer:Graphite 0.5:9.5 | 0.3 | 1.5 | 0.3 |

EXAMPLE 10

By means of the preparation device as shown in FIG. 13, an image forming member having oxygen depth profiles in the first and the second layer regions in FIG. 16 was formed under the conditions as indicated in Table 3B.

Other conditions were the same as in Example 8.

Using the thus obtained image forming member, images were formed on transfer papers according to the same procedure and under the same conditions as in Example 8 to obtain a very clear image quality.

TABLE 3B

| Gases employed | Flow rate (SCCM) | Flow rate ratio (Area ratio) | Discharging power (W/cm$^2$) | Layer formation speed (Å/sec) | Layer thickness (μ) |
|---|---|---|---|---|---|
| | | Amorphous layer (I) | | | |
| First layer region | | | | | |
| $SiH_4$/He = 0.5<br>NO<br>$B_2H_6$/He = $10^{-3}$ | $SiH_4$ = 200 | NO/$SiH_4$= $1.2 \times 10^{-1} \sim 3 \times 10^{-4}$<br>$B_2H_6$/$SiH_4$ = $1.5 \times 10^{-3}$ | 0.18 | 15 | 1.0 |
| Second layer region | | | | | |
| $SiH_4$/He = 0.5<br>NO | $SiH_4$ = 200 | NO/$SiH_4$ = $3 \times 10^{-4}$ | 0.18 | 15 | 20 |
| | | Amorphous layer (II) | | | |
| Ar | 200 | Si wafer:Graphite 6:4 | 0.3 | 3 | 1.0 |

EXAMPLE 11

Image forming members were prepared, respectively, in entirely the same manner as in Example 10 except that the content ratio of silicon atoms to carbon atoms in the second amorphous layer (II) was varied by varying the area ratio of silicon wafer to graphite wafer during formation of the second amorphous layer (II). For each of the thus obtained image forming members, the steps of image formation, development, and cleaning as described in Example 8 were repeated for about 50,000 times to obtain the results as shown in Table 4B.

TABLE 4B

| Sample No. | 401B | 402B | 403B | 404B | 405B | 406B | 407B |
|---|---|---|---|---|---|---|---|
| Si:C Target (Area ratio) | 9:1 | 6.5:3.5 | 4:6 | 2:8 | 1:9 | 0.5:9.5 | 0.2:9.8 |
| Si:C (Content ratio) | 9.7:0.3 | 8.8:1.2 | 7.3:2.7 | 4.8:5.2 | 3:7 | 2:8 | 0.8:9.2 |
| Evaluation of the image quality | Δ | ○ | ◎ | ◎ | ◎ | ○ | x |

◎ : Very good
○ : Good
Δ: Practically satisfactory
x: Liable to form image defect

EXAMPLE 12

Image forming members were prepared, respectively, in entirely the same manner as in Example 8 except that the layer thickness of the second amorphous layer (II) was varied. The steps of image formation, development, and cleaning as described in Example 8 were repeated to obtain the results as shown in Table 5B.

TABLE 5B

| Sample No. | Thickness of amorphous layer (II) (μ) | Results |
|---|---|---|
| 501B | 0.001 | Image defect liable to occur |
| 502B | 0.02 | No image defect during 20,000 |

TABLE 5B-continued

| Sample | Thickness of amorphous layer (II) | No. | (μ) | Results |
|---|---|---|---|---|
| | | | | repetitions |
| | | 503B | 0.05 | Stable for 50,000 repetitions or more |
| | | 504B | 0.3 | Stable for 100,000 repetitions or more |

EXAMPLE 13

Layer formations were conducted in entirely the same manner as in Example 8 except that the methods for forming the first and the second layer regions were changed as indicated in Table 6B, and evaluation of the image quality was performed similarly as in Example 8 to obtain good results.

TABLE 6B

| | | Gases employed | Flow rate (SCCM) | Flow rate ratio | Discharging power (W/cm²) | Layer formation speed (Å/sec) | Layer thickness (μ) |
|---|---|---|---|---|---|---|---|
| Amorphous layer (I) | First layer region | $SiH_4/He = 0.5$<br>$SiF_4/He = 0.5$<br>NO<br>$B_2H_6/He = 10^{-3}$ | $SiH_4 + SiF_4 = 200$ | $NO/SiH_4 + SiF_4 = 1 \times 10^{-1} \sim 1 \times 10^{-4}$<br>$B_2H_6/SiH_4 + SiF_4 = 4 \times 10^{-3}$ | 0.18 | 15 | 0.6 |
| | Second layer region | $SiH_4/He = 0.5$<br>$SiF_4/He = 0.5$<br>NO | $SiH_4 + SiF_4 = 200$ | $NO/SiH_4 + SiF_4 = 1 \times 10^{-4}$ | 0.18 | 15 | 20 |

EXAMPLE 14

By means of the preparation device as shown in FIG. 13, there was prepared an image forming member having oxygen depth profiles in the first and the second layer regions as shown in FIG. 17 under the conditions as indicated in Table 7B.

Other conditions were the same as in Example 8.

Using the thus obtained image forming member, images were formed on transfer papers according to the same procedure and under the same conditions as in Example 8 to obtain a very clear image quality.

TABLE 7B

| Gases employed | Flow rate (SCCM) | Flow rate ratio (or Area ratio) | Discharging power (W/cm²) | Layer formation speed (Å/sec) | Layer thickness (μ) |
|---|---|---|---|---|---|
| | | Amorphous layer (I) | | | |
| First layer region | | | | | |
| $SiH_4/He = 0.5$<br>NO<br>$B_2H_6/He = 10^{-3}$ | $SiH_4 = 200$ | $NO/SiH_4 = 8 \times 10^{-2} \sim 1 \times 10^{-2}$<br>$B_2H_6/SiH_4 = 8 \times 10^{-5}$ | 0.18 | 15 | 19 |
| Second layer region | | | | | |
| $SiH_4/He = 0.5$<br>NO | $SiH_4 = 200$ | $NO/SiH_4 = 1 \times 10^{-2} \sim 1 \times 10^{-4}$ | 0.18 | 15 | 1 |
| | | Amorphous layer (II) | | | |
| Ar | 200 | Si wafer:Graphite 1.5:8.5 | 0.3 | 2 | 0.3 |

EXAMPLE 15

By means of the preparation device as shown in FIG. 12, there was prepared an image forming member having oxygen depth profiles in the first and the second layer regions as shown in FIG. 14 under the conditions as indicated in Table 1C.

The image forming member thus obtained was set in a charging-exposure-developing device, subjected to corona charging at ⊕ 5.0 kV for 0.2 sec, followed immediately by irradiation of a light image. As the light source, a tungsten lamp was employed and irradiation was effected at a dose of 1.5 lux.sec. using a transmissive type test chart.

Immediately thereafter, a negatively charged developer (containing toner and carrier) was cascaded onto the surface of the image forming member, whereby a good toner image was obtained thereon. When the toner image on the member was transferred onto a transfer paper subjected to corona charging at ⊕ 5.0 kV, there was obtained a clear image with high density which was excellent in resolving power and good in gradation reproduction.

TABLE 1C

| Gases employed | Flow rate (SCCM) | Flow rate ratio | Discharging power (W/cm²) | Layer formation speed (Å/sec) | Layer thickness (μ) |
|---|---|---|---|---|---|
| | | Amorphous layer (I) | | | |
| First layer region | | | | | |
| $SiH_4/He = 0.5$<br>NO | $SiH_4 = 200$ | $NO/SiH_4 = 1 \times 10^{-1} \sim 1 \times 10^{-4}$ | 0.18 | 15 | 0.6 |

TABLE 1C-continued

| Gases employed | Flow rate (SCCM) | Flow rate ratio | Discharging power (W/cm²) | Layer formation speed (A/sec) | Layer thickness (μ) |
|---|---|---|---|---|---|
| $B_2H_6/He = 10^{-3}$ | | $B_2H_6/SiH_4 = 4 \times 10^{-3}$ | | | |
| Second layer region | | | | | |
| $SiH_4/He = 0.5$ NO | $SiH_4 = 200$ | $NO/SiH_4 = 1 \times 10^{-4}$ | 0.18 | 15 | 20 |
| | | Amorphous layer (II) | | | |
| $SiH_4/He = 0.5$ $C_2H_4$ | $SiH_4 = 50$ | $SiH_4:C_2H_4 = 3:7$ | 0.18 | 6 | 0.5 |

Substrate temperature: 250° C.
Discharging frequency: 13.56 MHz
Inner pressure during reaction: 0.5 Torr

EXAMPLE 16

By means of the preparation device as shown in FIG. 12, an image forming member having oxygen depth profiles in the first and the second layer regions in FIG. 15 was formed under the conditions as indicated in Table 2C.

Other conditions were the same as in Example 15.

Using the thus obtained image forming member, images were formed on transfer papers according to the same procedure and under the same conditions as in Example 15 to obtain a very clear image quality.

TABLE 2C

| Gases employed | Flow rate (SCCM) | Flow rate ratio | Discharging power (W/cm²) | Layer formation speed (Å/sec) | Layer thickness (μ) |
|---|---|---|---|---|---|
| | | Amorphous layer (I) | | | |
| First layer region | | | | | |
| $SiH_4/He = 0.5$ NO $B_2H_6/He = 10^{-3}$ | $SiH_4 = 200$ | $NO/SiH_4 = 3 \times 10^{-2} \sim 2 \times 10^{-2}$ $B_2H_6/SiH_4 = 2 \times 10^{-3}$ | 0.18 | 15 | 0.8 |
| Second layer region | | | | | |
| $SiH_4/He = 0.5$ NO | $SiH_4 = 200$ | $NO/SiH_4 = 2 \times 10^{-4} \sim 7 \times 10^{-4}$ | 0.18 | 15 | 20 |
| | | Amorphous layer (II) | | | |
| $SiH_4/He = 0.5$ $C_2H_4$ | $SiH_4 = 15$ | $SiH_4:C_2H_4 = 0.9:9.6$ | 0.18 | 1.5 | 0.3 |

EXAMPLE 17

By means of the preparation device as shown in FIG. 12, an image forming member having oxygen depth profiles in the first and the second layer regions in FIG. 16 was formed under the conditions as indicated in Table 3C.

Other conditions were the same as in Example 15.

Using the thus obtained image forming member, images were formed on transfer papers according to the same procedure and under the same conditions as in Example 15 to obtain a very clear image quality.

TABLE 3C

| Gases employed | Flow rate (SCCM) | Flow rate ratio | Discharging power (W/cm²) | Layer formation speed (Å/sec) | Layer thickness (μ) |
|---|---|---|---|---|---|
| | | Amorphous layer (I) | | | |
| First layer region | | | | | |
| $SiH_4/He = 0.5$ NO $B_2H_6/He = 10^{-3}$ | $SiH_4 = 200$ | $NO/SiH_4 = 1.2 \times 10^{-1} \sim 3 \times 10^{-4}$ $B_2H_6/SiH_4 = 1.5 \times 10^{-3}$ | 0.18 | 15 | 1.0 |
| Second layer region | | | | | |
| $SiH_4/He = 0.5$ NO | $SiH_4 = 200$ | $NO/SiH_4 = 3 \times 10^{-4}$ | 0.18 | 15 | 20 |
| | | Amorphous layer (II) | | | |
| $SiH_4/He = 0.5$ $C_2H_4$ | $SiH_4 = 100$ | $SiH_4:C_2H_4 = 5:5$ | 0.18 | 8 | 1.5 |

EXAMPLE 18

Layer formations were conducted, respectively, in entirely the same manner as in Example 15 except that the content ratio of silicon atoms to carbon atoms in the amorphous layer (II) was varied by varying the flow rate ratio of $SiH_4$ gas to $C_2H_4$ gas during formation of the amorphous layer (II). For each of the thus obtained image forming members for electrophotography, the steps up to transfer were repeated similarly as described in Example 15 for about 50,000 times, followed by evaluation of the images, to obtain the results as shown in Table 4C.

TABLE 4C

| Sample No. | 401C | 402C | 403C | 404C | 405C | 406C | 407C | 408C |
|---|---|---|---|---|---|---|---|---|
| $SiH_4$: $C_2H_4$ (Flow rate ratio) | 9:1 | 6:4 | 4:6 | 2:8 | 1:9 | 0.5: 9.5 | 0.35: 9.65 | 0.2: 9.8 |
| Si:C (Content ratio) | 9:1 | 7:3 | 5.5: 4.5 | 4:6 | 3:7 | 2:8 | 1.2: 8.8 | 0.8: 9.2 |
| Evaluation of the image quality | ○ | ◎ | ◎ | ◎ | ◎ | ◎ | ○ | x |

◎: Very good
○ : Good
x: Liable to form image defect

TABLE 5C

| Sample No. | Thickness of amorphous layer (II) (μ) | Results |
|---|---|---|
| 501C | 0.001 | Image defect liable to occur |
| 502C | 0.02 | No image defect during 20.000 repetitions |
| 503C | 0.05 | No image defect during 50.000 repetitions |
| 504C | 2 | Stable for 200.000 repetitions or more |

EXAMPLE 20

Layer formations were conducted in entirely the same manner as in Example 15 except that the methods for forming the first and the second layer regions were changed as indicated in Table 6C, and evaluation of the image quality was performed similarly as in Example 15 to obtain good results.

TABLE 6C

| Gases employed | Flow rate (SCCM) | Flow rate ratio | Discharging power ($W/cm^2$) | Layer formation speed (Å/sec) | Layer thickness (μ) |
|---|---|---|---|---|---|
| | | Amorphous layer (I) | | | |
| First layer region | | | | | |
| $SiH_4/He = 0.5$<br>$SiF_4/He = 0.5$<br>NO<br>$B_2H_6/He = 10^{-3}$ | $SiH_4 + SiF_4 = 200$ | $NO/SiH_4 + SiF_4 = 1 \times 10^{-1} \sim 1 \times 10^{-4}$<br>$B_2H_6/SiH_4 + SiF_4 = 4 \times 10^{-3}$ | 0.18 | 15 | 0.6 |
| Second layer region | | | | | |
| $SiH_4/He = 0.5$<br>$SiF_4/He = 0.5$<br>NO | $SiH_4 + SiF_4 = 200$ | $NO/SiH_4 + SiF_4 = 1 \times 10^{-4}$ | 0.18 | 15 | 20 |

EXAMPLE 19

Layer formations were conducted, respectively, in entirely the same manner as in Example 15 except that the layer thickness of the amorphous layer (II) was varied as shown in Table 5C. The results of evaluation are as shown in Table 5C.

EXAMPLE 21

By means of the preparation device as shown in FIG. 12, an image forming member having oxygen depth profiles in the first and the second layer regions in FIG. 17 was formed under the conditions as indicated in Table 7C.

Other conditions were the same as in Example 15.

Using the thus obtained image forming member, images were formed on transfer papers according to the same procedure and under the same conditions as in Example 15 to obtain a very clear image quality.

TABLE 7C

| Gases employed | Flow rate (SCCM) | Flow rate ratio | Discharging power ($W/cm^2$) | Layer formation speed (Å/sec) | Layer thickness (μ) |
|---|---|---|---|---|---|
| | | Amorphous layer (I) | | | |
| First layer region | | | | | |
| $SiH_4/He = 0.5$<br>NO<br>$B_2H_6/He = 10^{-3}$ | $SiH_4 = 200$ | $NO/SiH_4 = 8 \times 10^{-2} \sim 1 \times 10^{-2}$<br>$B_2H_6/SiH_4 = 8 \times 10^{-5}$ | 0.18 | 15 | 19 |
| Second layer region | | | | | |
| $SiH_4/He = 0.5$<br>NO | $SiH_4 = 200$ | $NO/SiH_4 = 1 \times 10^{-2} \sim 1 \times 10^{-4}$ | 0.18 | 15 | 1 |
| | | Amorphous layer (II) | | | |
| $SiH_4/He = 0.5$<br>$C_2H_4$ | $SiH_4 = 50$ | $SiH_4:C_2H_4 = 3:7$ | 0.18 | 6 | 0.5 |

EXAMPLE 22

By means of the preparation device as shown in FIG. 13, there was prepared an image forming member having oxygen depth profiles in the first and the second layer regions as shown in FIG. 14 under the conditions as indicated in Table 1D.

The image forming member thus obtained was set in a charging-exposure-developing device, subjected to corona charging at ⊕ 5.0 kV for 0.2 sec, followed immediately by irradiation of a light image. As the light source, a tungsten lamp was employed and irradiation was effected at a dose of 1.5 lux.sec. using a transmissive type test chart.

Immediately thereafter, a negatively charged developer (containing toner and carrier) was cascaded onto the surface of the image forming member, whereby a good toner image was obtained thereon. When the toner image on the member was transferred onto a transfer paper subjected to corona charging at ⊕ 5.0 kV, there was obtained a clear image with high density which was excellent in resolving power and good in gradation reproduction.

TABLE 1D

| Gases employed | Flow rate (SCCM) | Flow rate ratio | Discharging power (W/cm$^2$) | Layer formation speed (Å/sec) | Layer thickness (μ) |
|---|---|---|---|---|---|
| | | Amorphous layer (I) | | | |
| First layer region | | | | | |
| $SiH_4$/He = 0.5<br>NO<br>$B_2H_6$/He = $10^{-3}$ | $SiH_4$<br>=200 | NO/$SiH_4$ = $1 \times 10^{-1}$~<br>$1 \times 10^{-4}$<br>$B_2H_6$/$SiH_4$ = $4 \times 10^{-3}$ | 0.18 | 15 | 0.6 |
| Second layer region | | | | | |
| $SiH_4$/He = 0.5<br>NO | $SiH_4$<br>= 200 | NO/$SiH_4$ = $1 \times 10^{-4}$ | 0.18 | 15 | 20 |
| | | Amorphous layer (II) | | | |
| $SiH_4$/He = 0.5<br>$SiF_4$/He = 0.5<br>$C_2H_4$ | $SiH_4$<br>+ $SiF_4$<br>= 50 | $SiH_4$:$SiF_4$:$C_2H_4$<br>= 1.5:1.5:7 | 0.18 | 6 | 0.5 |

Substrate temperature: 250 °C.
Discharging frequency: 13.56 MHz
Inner pressure during reaction: 0.5 Torr

EXAMPLE 23

By means of the preparation device as shown in FIG. 13, an image forming member having oxygen depth profiles in the first and the second layer regions in FIG. 15 was formed under the conditions as indicated in Table 2D.

Other conditions were the same as in Example 22.

Using the thus obtained image forming member, images were formed on transfer papers according to the same procedure and under the same conditions as in Example 22 to obtain a very clear image quality.

TABLE 2D

| Gases employed | Flow rate (SCCM) | Flow rate ratio | Discharging power (W/cm$^2$) | Layer formation speed (Å/sec) | Layer thickness (μ) |
|---|---|---|---|---|---|
| | | Amorphous layer (I) | | | |
| First layer region | | | | | |
| $SiH_4$/He = 0.5<br>NO<br>$B_2H_6$/He = $10^{-3}$ | $SiH_4$<br>= 200 | NO/$SiH_4$ = $3 \times 10^{-2}$~<br>$2 \times 10^{-2}$<br>$B_2H_6$/$SiH_4$ = $2 \times 10^{-3}$ | 0.18 | 15 | 0.8 |
| Second layer region | | | | | |
| $SiH_4$/He = 0.5<br>NO | $SiH_4$<br>= 200 | NO/$SiH_4$ = $2 \times 10^{-2}$~<br>$7 \times 10^{-4}$ | 0.18 | 15 | 20 |
| | | Amorphus layer (II) | | | |
| $SiH_4$/He = 0.5<br>$SiF_4$/He = 0.5<br>$C_2H_4$ | $SiH_4$<br>+ $SiF_4$<br>= 15 | $SiH_4$:$SiF_4$:$C_2H_4$<br>= 0.3:0.1:9.6 | 0.18 | 1.5 | 0.3 |

EXAMPLE 24

By means of the preparation device as shown in FIG. 13, an image forming member having oxygen depth profiles in the first and the second layer regions in FIG. 16 was formed under the conditions as indicated in Table 3D.

Other conditions were the same as in Example 22.

Using the thus obtained image forming member, images were formed on transfer papers according to the same procedure and under the same conditions as in Example 22 to obtain a very clear image quality.

TABLE 3D

| Gases employed | Flow rate (SCCM) | Flow rate ratio | Discharging power (W/cm²) | Layer formation speed (Å/sec) | Layer thickness (μ) |
|---|---|---|---|---|---|
| | | Amorphous layer (I) | | | |
| First layer region | | | | | |
| $SiH_4/He = 0.5$<br>NO<br>$B_2H_6/He = 10^{-3}$ | $SiH_4$ = 200 | $NO/SiH_4 = 1.2 \times 10^{-1} \sim 3 \times 10^{-4}$<br>$B_2H_6/SiH_4 = 1.5 \times 10^{-3}$ | 0.18 | 15 | 1.0 |
| Second layer region | | | | | |
| $SiH_4/He = 0.5$<br>NO | $SiH_4$ = 200 | $NO/SiH_4 = 3 \times 10^{-4}$ | 0.18 | 15 | 20 |
| | | Amorphous layer (II) | | | |
| $SiH_4/He = 0.5$<br>$SiF_4/He = 0.5$<br>$C_2H_4$ | $SiH_4 + SiF_4$ = 150 | $SiH_4:SiF_4:C_2H_4$ = 3:3:4 | 0.18 | 10 | 1.5 |

EXAMPLE 25

Image forming members were prepared, respectively, in entirely the same manner as in Example 22 except that the content ratio of silicon atoms to carbon atoms in the amorphous layer (II) was varied by varying the flow rate ratio of $SiH_4$ gas:$SiF_4$ gas:$C_2H_4$ gas during formation of the amorphous layer (II). For each of the thus obtained image forming members, the steps of image formation, development, and cleaning as described in Example 22 were repeated for about 50,000 times and the resultant images were evaluated to obtain the results as shown in Table 4D.

TABLE 4D

| Sample No. | 401D | 402D | 403D | 404D | 405D | 406D | 407D | 408D |
|---|---|---|---|---|---|---|---|---|
| $SiH_4:SiF_4:C_2H_4$ (Flow rate ratio) | 5:4:1 | 3:3.5:3.5 | 2:2:6 | 1:1:8 | 0.6:0.4:9 | 0.2:0.3:9.5 | 0.2:0.15:9.65 | 0.1:0.1:9.8 |
| Si:C (Content ratio) | 9:1 | 7:3 | 5.5:4.5 | 4:6 | 3:7 | 2:8 | 1.2:8.8 | 0.8:9.2 |
| | ○ | ◎ | ◎ | ◎ | ◎ | ◎ | ○ | x |

◎ : Very good
○ : Good
x: Liable to form image defect

EXAMPLE 26

Image forming members were prepared, respectively, in entirely the same manner as in Example 22 except that the layer thickness of the second amorphous layer (II) was varied. The steps of image formation, development, and cleaning as described in Example 22 were repeated to obtain the results as shown in Table 5D.

TABLE 5D

| Sample No. | Thickness of amorphous layer (II) (μ) | Results |
|---|---|---|
| 501D | 0.001 | Liable to form image defect |
| 502D | 0.02 | No image defect during 20,000 repetitions |
| 503D | 0.05 | Stable for 50,000 repetitions or more |
| 504D | 1 | Stable for 200,000 repetitions or more |

EXAMPLE 27

Layer formations were conducted in entirely the same manner as in Example 22 except that the methods for forming the first and the second layer regions were changed as indicated in Table 6D, and evaluation of the image quality was performed similarly as in Example 22 to obtain good results.

TABLE 6D

| | | Gases employed | Flow rate (SCCM) | Flow rate ratio | Discharging power (W/cm²) | Layer formation speed (Å/sec) | Layer thickness (μ) |
|---|---|---|---|---|---|---|---|
| Amorphous layer (I) | First layer region | $SiH_4/He = 0.5$<br>$SiF_4/He = 0.5$<br>NO<br>$B_2H_6/He = 10^{-3}$ | $SiH_4 + SiF_4$ = 200 | $NO/SiH_4 + SiF_4 = 1 \times 10^{-1} \sim 1 \times 10^{-4}$<br>$B_2H_6/SiH_4 + SiF_4 = 4 \times 10^{-3}$ | 0.18 | 15 | 0.6 |
| | Second layer region | $SiH_4/He = 0.5$<br>$SiF_4/He = 0.5$<br>NO | $SiH_4 + SiF_4$ = 200 | $NO/SiH_4 + SiF_4 = 1 \times 10^{-4}$ | 0.18 | 15 | 20 |

EXAMPLE 28

By means of the preparation device as shown in FIG. 13, an image forming member having an oxygen depth profile as shown in FIG. 17 was formed under the conditions as indicated in Table 7D.

Other conditions were the same as in Example 22.

Using the thus obtained image forming member, images were formed on transfer papers according to the same procedure and under the same conditions as in Example 22 to obtain a very clear image quality.

TABLE 7D

| | | Gases employed | Flow rate (SCCM) | Flow rate ratio | Discharging power (W/cm$^2$) | Layer formation speed (Å/sec) | Layer thickness (μ) |
|---|---|---|---|---|---|---|---|
| Amorphous layer (I) | First layer region | $SiH_4/He = 0.5$<br>NO<br>$B_2H_6/He = 10^{-3}$ | $SiH_4 = 200$ | $NO/SiH_4 = 8 \times 10^{-2} \sim 1 \times 10^{-2}$<br>$B_2H_6/SiH_4 = 8 \times 10^{-5}$ | 0.18 | 15 | 19 |
| | Second layer region | $SiH_4/He = 0.5$<br>NO | $SiH_4 = 200$ | $NO/SiH_4 = 1 \times 10^{-2} \sim 1 \times 10^{-4}$ | 0.18 | 15 | 1 |
| Amorphous layer (II) | | $SiH_4/He = 0.5$<br>$SiF_4/He = 0.5$<br>$C_2H_4$ | $SiH_4 + SiF_4 = 50$ | $SiH_4:SiF_4:C_2H_4 = 1.5:1.5:7$ | 0.18 | 6 | 0.5 |

EXAMPLE 29

By means of the preparation device as shown in FIG. 12, an amorphous layer having an oxygen depth profile as shown in FIG. 14 was formed on an Al cylindrical substrate under the conditions as indicated in Table 1E.

The image forming member thus obtained was set in a charging-exposure-developing device, subjected to corona charging at ⊖ 5.0 kV for 0.2 sec, followed immediately by irradiation of a light image. As the light source, a tungsten lamp was employed and irradiation was effected at a dose of 1.5 lux.sec. using a transmissive type test chart.

Immediately thereafter, a positively charged developer (containing toner and carrier) was cascaded onto the surface of the image forming member, whereby a good toner image was obtained thereon. When the toner image on the member was transferred onto a transfer paper subjected to corona charging at ⊖ 5.0 kV, there was obtained a clear image with high density which was excellent in resolving power and good in gradation reproduction.

TABLE 1E

| | Gases employed | Flow rate (SCCM) | Flow rate ratio | Discharging power (W/cm$^2$) | Layer formation speed (Å/sec) | Layer thickness (μ) |
|---|---|---|---|---|---|---|
| First layer region | $SiH_4/He = 0.5$<br>NO<br>$PH_3/He = 10^{-3}$ | $SiH_4 = 200$ | $NO/SiH_4 = 1 \times 10^{-1} \sim 1 \times 10^{-4}$<br>$PH_3/SiH_4 = 8 \times 10^{-4}$ | 0.18 | 15 | 0.6 |
| Second layer region | $SiH_4/He = 0.5$<br>NO | $SiH_4 = 200$ | $NO/SiH_4 = 1 \times 10^{-4}$ | 0.18 | 15 | 20 |

Substrate temperature: 250° C.
Discharging frequency: 13.56 MHz
Inner pressure during reaction: 0.5 Torr

EXAMPLE 30

By means of the preparation device as shown in FIG. 12, an amorphous layer having an oxygen depth profile as shown in FIG. 15 was formed under the conditions as indicated in Table 2E.

Other conditions were the same as in Example 29.

Using the thus obtained image forming member, images were formed on transfer papers according to the same procedure and under the same conditions as in Example 29 to obtain a very clear image quality.

TABLE 2E

| | Gases employed | Flow rate (SCCM) | Flow rate ratio | Discharging power (W/cm$^2$) | Layer formation speed (Å/sec) | Layer thickness (μ) |
|---|---|---|---|---|---|---|
| First layer region | $SiH_4/He = 0.5$<br>NO<br>$PH_3/He = 10^{-3}$ | $SiH_4 = 200$ | $NO/SiH_4 = 3 \times 10^{-2} \sim 2 \times 10^{-2}$<br>$PH_3/SiH_4 = 1 \times 10^{-3}$ | 0.18 | 15 | 0.8 |
| Second layer region | $SiH_4/He = 0.5$<br>NO | $SiH_4 = 200$ | $NO/SiH_4 = 2 \times 10^{-2} \sim 7 \times 10^{-4}$ | 0.18 | 15 | 20 |

EXAMPLE 31

By means of the preparation device as shown in FIG. 12, an amorphous layer having an oxygen depth profile as shown in FIG. 16 was formed under the conditions as indicated in Table 3E.

Other conditions were the same as in Example 29.

Using the thus obtained image forming member, images were formed on transfer papers according to the same procedure and under the same conditions as in Example 29 to obtain a very clear image quality.

TABLE 3E

| | Gases employed | Flow rate (SCCM) | Flow rate ratio | Discharging power (W/cm$^2$) | Layer formation speed (Å/sec) | Layer thickness (μ) |
|---|---|---|---|---|---|---|
| First layer region | $SiH_4/He = 0.5$<br>NO<br>$PH_3/He = 10^{-3}$ | $SiH_4 = 200$ | $NO/SiH_4 = 1.2 \times 10^{-1} \sim 3 \times 10^{-4}$<br>$PH_3/SiH_4 = 1.5 \times 10^{-3}$ | 0.18 | 15 | 1.0 |
| Second layer region | $SiH_4/He = 0.5$<br>NO | $SiH_4 = 200$ | $NO/SiH_4 = 3 \times 10^{-4}$ | 0.18 | 15 | 20 |

EXAMPLE 32

Layer formations were conducted in entirely the same manner as in Example 29 except that the content ratio of phosphorous atoms in the first layer region was varied by varying the flow rate ratio of $PH_3$ to $SiH_4$ during formation of the first layer region. As the result, there were obtained the results as shown in Table 4E.

TABLE 4E

| Sample No. | 401E | 402E | 403E | 404E | 405E |
|---|---|---|---|---|---|
| P/Si (Content ratio) | $5 \times 10^{-4}$ | $1 \times 10^{-3}$ | $3 \times 10^{-3}$ | $6 \times 10^{-3}$ | $1 \times 10^{-2}$ |
| Evaluation of the image quality | ○ | ◎ | ◎ | ◎ | ○ |

◎ Very good
○: Good

EXAMPLE 33

Layer formations were conducted in entirely the same manner as in Example 30 except that the layer thickness of the first layer region was varied as shown in Table 5E to obtain the results as shown in Table 5E.

TABLE 5E

| Sample No. | 501E | 502E | 503E | 504E | 505E | 506E | 507E |
|---|---|---|---|---|---|---|---|
| Thickness of first layer region (μ) | 0.05 | 0.1 | 0.3 | 0.5 | 2 | 5 | 7 |
| Evaluation of the image quality | ○ | ⊙ | ⊙ | ⊙ | ⊙ | ○ | Δ |

◎ : Very good
○: Good
Δ: Practically useful

EXAMPLE 34

Layer formations were conducted in entirely the same manner as in Example 29 except that the methods for forming the first and the second layer regions were changed as indicated in Table 6E, and evaluation of the image quality was performed similarly as in Example 29 to obtain good results.

TABLE 6E

| | Gases employed | Flow rate (SCCM) | Flow rate ratio | Discharging power (W/cm$^2$) | Layer formation speed (Å/sec) | Layer thickness (μ) |
|---|---|---|---|---|---|---|
| First layer region | $SiH_4/He = 0.5$<br>$SiF_4/He = 0.5$<br>NO<br>$PH_3/He = 10^{-3}$ | $SiH_4 + SiF_4 = 200$ | $NO/(SiH_4 + SiF_4) = 1 \times 10^{-1} \sim 1 \times 10^{-4}$<br>$PH_3/(SiH_4 + SiF_4) = 4 \times 10^{-3}$ | .18 | 15 | 0.6 |
| Second layer region | $SiH_4/He = 0.5$<br>$SiF_4/He = 0.5$<br>NO | $SiH_4 + SiF_4 = 200$ | $NO/(SiH_4 + SiF_4) = 4 \times 10^{-4}$ | 0.18 | 15 | 20 |

EXAMPLE 35

By means of the preparation device as shown in FIG. 12, an amorphous layer having an oxygen depth profile as shown in FIG. 17 was formed on an Al cylinder under the conditions as indicated in Table 7E.

Other conditions were the same as in Example 29.

Using the thus obtained image forming member, images were formed on transfer papers according to the same procedure and under the same conditions as in Example 29 to obtain a very clear image quality.

TABLE 7E

| | Gases employed | Flow rate (SCCM) | Flow rate ratio | Discharging power (W/cm$^2$) | Layer formation speed (Å/sec) | Layer thickness (μ) |
|---|---|---|---|---|---|---|
| First layer region | $SiH_4/He = 0.5$<br>NO<br>$PH_3/He = 10^{-3}$ | $SiH_4 = 200$ | $NO/SiH_4 = 8 \times 10^{-2} \sim 1 \times 10^{-2}$<br>$PH_3/SiH_4 = 8 \times 10^{-3}$ | 0.18 | 15 | 2 |
| Second layer region | $SiH_4/He = 0.5$<br>NO | $SiH_4 = 200$ | $NO/SiH_4 = 1 \times 10^{-2} \sim 1 \times 10^{-4}$ | 0.18 | 15 | 18 |

EXAMPLE 35A

Image forming members for electrophography were prepared, respectively, according to the same procedure and under the same conditions as shown in Example 31, except that the layer forming conditions were changed to those as indicated in Table 8E during formation of the second layer region in Example 31, and evaluated similarly as in Example 29 to obtain good results for respective samples, particularly with respect to image quality and durability.

TABLE 8E

| Conditions | Gases employed | Flow rate (SCCM) | Flow rate ratio | Layer thickness (μ) |
|---|---|---|---|---|
| 1 | $SiH_4/He = 1$<br>$B_2H_6/He = 10^{-2}$<br>NO | $SiH_4 = 200$ | $B_2H_6/SiH_4 = 2 \times 10^{-5}$<br>$NO/SiH_4 = 3 \times 10^{-4}$ | 15 |
| 2 | $SiH_4/He = 1$<br>$B_2H_6/He = 10^{-2}$<br>NO | $SiH_4 = 200$ | $B_2H_6/SiH_4 = 1 \times 10^{-5}$<br>$NO/SiH_4 = 3 \times 10^{-4}$ | 15 |
| 3 | $Si_2H_6/He = 1$<br>$B_2H_6/He = 10^{-2}$<br>NO | $Si_2H_6 = 170$ | $B_2H_6/Si_2H_6 = 3 \times 10^{-4}$<br>$NO/Si_2H_6 = 3 \times 10^{-4}$ | 10 |
| 4 | $SiH_4/He = 1$<br>$SiF_4/He = 1$<br>$B_2H_6/He = 10^{-2}$<br>NO | $SiH_4 + SiF_4 = 100$ | $SiH_4/SiF_4 = 8/2$<br>$B_2H_6/(SiH_4 + SiF_4) = 2 \times 10^{-5}$<br>$NO/(SiH_4 + SiF_4) = 3 \times 10^{-4}$ | 15 |

EXAMPLE 36

By means of the preparation device as shown in FIG. 13, there was prepared an image forming member having oxygen depth profiles in the first and the second layer regions as shown in FIG. 14 under the conditions as indicated in Table 1F.

The image forming member thus obtained was set in a charging-exposure-developing device, subjected to corona charging at ⊖5.0 kV for 0.2 sec, followed immediately by irradiation of a light image. As the light source, a tungsten lamp was employed and irradiation was effected at a dose of 1.5 lux.sec. using a transmissive type test chart.

Immediately thereafter, a positively charged developer (containing toner and carrier) was cascaded onto the surface of the image forming member, whereby a good toner image was obtained thereon. When the toner image on the member was transferred onto a transfer paper subjected to corona charging at ⊖5.0 kV, there was obtained a clear image with high density which was excellent in resolving power and good in gradation reproduction.

TABLE 1F

| Layer constitution | | Gases employed | Flow rate (SCCM) | Flow rate ratio | Discharging power (W/cm²) | Layer formation speed (Å/sec) | Layer thickness (μ) |
|---|---|---|---|---|---|---|---|
| Amorphous layer (I) | First layer region | $SiH_4/He = 0.5$<br>NO<br>$PH_3/He = 10^{-3}$ | $SiH_4 = 200$ | $NO/SiH_4 = 1 \times 10^{-1} \sim 1 \times 10^{-4}$<br>$PH_3/SiH_4 = 8 \times 10^{-4}$ | 0.18 | 15 | 0.6 |
| | Second layer region | $SiH_4/He = 0.5$<br>NO | $SiH_4 = 200$ | $NO/SiH_4 = 1 \times 10^{-4}$ | 0.18 | 15 | 20 |
| Amorphous layer (II) | | Ar 200 | | Siwafer:graphite 1.5:8.5 | 0.3 | 2 | 0.3 |

Al substrate temperature: 250° C.
Discharging frequency: 13.56 MHz
Inner pressure during reaction: 0.5 Torr

EXAMPLE 37

By means of the preparation device as shown in FIG. 13, an image forming member having oxygen depth profiles in the first and the second layer regions in FIG. 15 was formed under the conditions as indicated in Table 2F.

Other conditions were the same as in Example 36.

Using the thus obtained image forming member, images were formed on transfer papers according to the same procedure and under the same conditions as in Example 36 to obtain a very clear image quality.

TABLE 2F

| Layer constitution | | Gases employed | Flow rate (SCCM) | Flow rate ratio (Area ratio) | Discharging power (W/cm²) | Layer formation speed (Å/sec) | Layer thickness (μ) |
|---|---|---|---|---|---|---|---|
| Amorphous layer (I) | First layer region | $SiH_4/He = 0.5$<br>NO<br>$PH_3/He = 10^{-3}$ | $SiH_4 = 200$ | $NO/SiH_4 = 3 \times 10^{-2} \sim 2 \times 10^{-2}$<br>$PH_3/SiH_4 = 1 \times 10^{-3}$ | 0.18 | 15 | 0.8 |
| | Second layer region | $SiH_4/He = 0.5$<br>NO | $SiH_4 = 200$ | $NO/SiH_4 = 2 \times 10^{-2} \sim 7 \times 10^{-4}$ | 0.18 | 15 | 20 |
| Amorphous layer (II) | | Ar | 200 | Si wafer:graphite 0.5:9.5 | 0.3 | 1.5 | 0.3 |

EXAMPLE 38

By means of the preparation device as shown in FIG. 13, an image forming member having oxygen depth profiles in the first and the second layer regions in FIG. 16 was formed under the conditions as indicated in Table 3F.

Other conditions were the same as in Example 36.

Using the thus obtained image forming member, images were formed on transfer papers according to the same procedure and under the same conditions as in Example 36 to obtain a very clear image quality.

TABLE 3F

| Layer constitution | | Gases employed | Flow rate (SCCM) | Flow rate ratio (Area ratio) | Discharging power (W/cm²) | Layer formation speed (Å/sec) | Layer thickness (μ) |
|---|---|---|---|---|---|---|---|
| Amorphous layer (I) | First layer region | $SiH_4/He = 0.5$ NO $PH_3/He = 10^{-3}$ | $SiH_4 = 200$ | $NO/SiH_4 = 1.2 \times 10^{-1} \sim 3 \times 10^{-4}$ $PH_3/SiH_4 = 1.5 \times 10^{-3}$ | 0.18 | 15 | 1.0 |
| | Second layer region | $SiH_4/He = 0.5$ NO | $SiH_4 = 200$ | $NO/SiH_4 = 3 \times 10^{-4}$ | 0.18 | 15 | 20 |
| Amorphous layer (II) | | Ar | 200 | Si wafer:graphite 6:4 | 0.3 | 3 | 1.0 |

EXAMPLE 39

Image forming members were prepared, respectively, in entirely the same manner as in Example 38 except that the content ratio of silicon atoms to carbon atoms in the second amorphous layer (II) was varied by varying the area ratio of silicon wafer to graphite wafer during formation of the second amorphous layer (II). For each of the thus obtained image forming members, the steps of image formation, development, and cleaning as described in Example 36 were repeated for about 50,000 times to obtain the results as shown in Table 4F.

TABLE 4F

| Sample No. | 401F | 402F | 403F | 404F | 405F | 406F | 407F |
|---|---|---|---|---|---|---|---|
| Si:C (Target) (Area ratio) | 9:1 | 6.5:3.5 | 4:6 | 2:8 | 1:9 | 0.5:9.5 | 0.2:9.8 |
| Si:C (Content ratio) | 9.7:0.3 | 8.8:1.2 | 7.3:2.7 | 4.8:5.2 | 3:7 | 2:8 | 0.8:9.2 |
| Evaluation of the image quality | Δ | ○ | ◎ | ◎ | ○ | Δ | x |

◎: Very good
○ : Good
Δ: Practically satisfactory
x: Liable to form image defect

EXAMPLE 40

Image forming members were prepared, respectively, in entirely the same manner as in Example 36 except that the layer thickness of the second amorphous layer (II). The steps of image formation, development, and cleaning as described in Example 36 were repeated to obtain the results as shown in Table 5F.

TABLE 5F

| Sample No. | Thickness of amorphous layer (II) was varied as shown in Table 5F (μ) | Results |
|---|---|---|
| 501F | 0.001 | Image defect liable to occur |
| 502F | 0.02 | No image defect during 20,000 repetitions |
| 503F | 0.05 | Stable for 50,000 repetitions or more |
| 504F | 0.3 | Stable for 100,000 repetitions or more |

EXAMPLE 41

Layer formations were conducted in entirely the same manner as in Example 36 except that the methods for forming the first and the second layer regions were changed as indicated in Table 6F, and evaluation of the image quality was performed similarly as in Example 36 to obtain good results.

TABLE 6F

| Layer constitution | | Gases employed | Flow rate (SCCM) | Flow rate ratio | Discharging power (W/cm²) | Layer formation speed (Å/sec) | Layer thickness (μ) |
|---|---|---|---|---|---|---|---|
| Amorphous layer (I) | First layer region | $SiH_4/He = 0.5$ $SiF_4/He = 0.5$ NO $PH_3/He = 10^{-3}$ | $SiH_4 = 200$ | $NO/(SiH_4 + SiF_4) = 1 \times 10^{-1} \sim 1 \times 10^{-4}$ $PH_3/(SiH_4 + SiF_4) = 4 \times 10^{-3}$ | 0.18 | 15 | 0.6 |
| | Second layer region | $SiH_4/He = 0.5$ $SiF_4/He = 0.5$ NO | $SiH_4 + SiF_4 = 200$ | $NO/(SiH_4 + SiF_4) = 1 \times 10^{-4}$ | 0.18 | 15 | 20 |

EXAMPLE 42

By means of the preparation device as shown in FIG. 13, an image forming member having oxygen depth profiles in the first and the second layer regions in FIG. 17 was formed under the conditions as indicated in Table 7F.

Other conditions were the same as in Example 36.

Using the thus obtained image forming member, images were formed on transfer papers according to the same procedure and under the same conditions as in Example 36 to obtain a very clear image quality.

TABLE 7F

| Layer constitution | | Gases employed | Flow rate (SCCM) | Flow rate ratio (Area ratio) | Discharging power ($W/cm^2$) | Layer formation speed (Å/sec) | Layer thickness ($\mu$) |
|---|---|---|---|---|---|---|---|
| Amorphous layer (I) | First layer region | $SiH_4/He = 0.5$<br>NO<br>$PH_3/He = 10^{-3}$ | $SiH_4 = 200$ | $NO/SiH_4 = 8 \times 10^{-2} \sim 1 \times 10^{-2}$<br>$PH_3/SiH_4 = 8 \times 10^{-5}$ | 0.18 | 15 | 2 |
| | Second layer region | $SiH_4/He = 0.5$<br>NO | $SiH_4 = 200$ | $NO/SiH_4 = 1 \times 10^{-2} \sim 1 \times 10^{-4}$ | 0.18 | 15 | 18 |
| Amorphous layer (II) | | Ar | 200 | Si wafer:graphite 1.5:8.5 | 0.3 | 2 | 0.3 |

EXAMPLE 43

Image forming members for electrophography were prepared, respectively, according to the same procedure and under the same conditions as shown in Example 38, except that the layer forming conditions were changed to those as indicated in Table 8F during formation of the second layer region in Example 38, and evaluated similarly as in Example 36 to obtain good results for respective samples, particularly with respect to image quality and durability.

TABLE 8F

| Conditions | Gases employed | Flow rate (SCCM) | Flow rate ratio | Layer thickness ($\mu$) |
|---|---|---|---|---|
| 1 | $SiH_4/He = 1$<br>$B_2H_6/He = 10^{-2}$<br>NO | $SiH_4 = 200$ | $B_2H_6/SiH_4 = 2 \times 10^{-5}$<br>$NO/SiH_4 = 3 \times 10^{-4}$ | 15 |
| 2 | $SiH_4/He = 1$<br>$B_2H_6/He = 10^{-2}$<br>NO | $SiH_4 = 200$ | $B_2H_6/SiH_4 = 1 \times 10^{-5}$<br>$NO/SiH_4 = 3 \times 10^{-4}$ | 15 |
| 3 | $Si_2H_6/He = 1$<br>$B_2H_6/He = 10^{-2}$<br>NO | $Si_2H_6 = 170$ | $B_2H_6/Si_2H_6 = 3 \times 10^{-4}$<br>$NO/Si_2H_6 = 3 \times 10^{-4}$ | 10 |
| 4 | $SiH_4/He = 1$<br>$SiF_4/He = 1$<br>$B_2H_6/He = 10^{-2}$<br>NO | $SiH_4 + SiF_4 = 100$ | $SiH_4/SiF_4 = 8/2$<br>$B_2H_6/(SiH_4 + SiF_4) = 2 \times 10^{-5}$<br>$NO/(SiH_4 + SiF_4) = 3 \times 10^{-4}$ | 15 |

TABLE 1G

| Layer constitution | | Gases employed | Flow rate (SCCM) | Flow rate ratio | Discharging power ($W/cm^2$) | Layer formation speed (Å/sec) | Layer thickness ($\mu$) |
|---|---|---|---|---|---|---|---|
| Amorphous layer (I) | First layer region | $SiH_4/He = 0.5$<br>NO<br>$PH_3/He = 10^{-3}$ | $SiH_4 = 200$ | $NO/SiH_4 = 1 \times 10^{-1} \sim 1 \times 10^{-4}$<br>$PH_3/SiH_4 = 8 \times 10^{-4}$ | 0.18 | 15 | 0.6 |
| | Second layer region | $SiH_4/He = 0.5$<br>NO | $SiH_4 = 200$ | $NO/SiH_4 = 1 \times 10^{-4}$ | 0.18 | 15 | 20 |
| Amorphous layer (II) | | $SiH_4/He = 0.5$<br>$C_2H_4$ | $SiH_4 = 50$ | $SiH_4:C_2H_4 = 3:7$ | 0.18 | 6 | 0.5 |

Al substrate temperature: 250° C.
Discharging frequency: 13.56 MHz
Inner pressure during reaction: 0.5 Torr

EXAMPLE 44

By means of the preparation device as shown in FIG. 12, there was prepared an image forming member having oxygen depth profiles in the first and the second layer regions as shown in FIG. 14 under the conditions as indicated in Table 1G.

The image forming member thus obtained was set in a charging-exposure-developing device, subjected to corona charging at ⊖5.0 kV for 0.2 sec, followed immediately by irradiation of a light image. As the light source, a tungsten lamp was employed and irradiation was effected at a dose of 1.5 lux.sec. using a transmissive type test chart.

Immediately thereafter, a positively charged developer (containing toner and carrier) was cascaded onto the surface of the image forming member, whereby a good toner image was obtained thereon. When the toner image on the member was transferred onto a transfer paper subjected to corona charging at ⊖5.0 kV, there was obtained a clear image with high density which was excellent in resolving power and good in gradation reproduction.

EXAMPLE 45

By means of the preparation device as shown in FIG. 12, an image forming member having oxygen depth profiles in the first and the second layer regions in FIG. 15 was formed under the conditions as indicated in Table 2G.

Other conditions were the same as in Example 44.

Using the thus obtained image forming member, images were formed on transfer papers according to the same procedure and under the same conditions as in Example 44 to obtain a very clear image quality.

TABLE 2G

| Layer constitution | | Gases employed | Flow rate (SCCM) | Flow rate ratio | Discharging power (W/cm²) | Layer formation speed (Å/sec) | Layer thickness (μ) |
|---|---|---|---|---|---|---|---|
| Amorphous layer (I) | First layer region | $SiH_4/He = 0.5$<br>NO<br>$PH_3/He = 10^{-3}$ | $SiH_4 = 200$ | $NO/SiH_4 = 3 \times 10^{-2} \sim 2 \times 10^{-2}$<br>$PH_3/SiH_4 = 1 \times 10^{-3}$ | 0.18 | 15 | 0.8 |
| | Second layer region | $SiH_4/He = 0.5$<br>NO | $SiH_4 = 200$ | $NO/SiH_4 = 2 \times 10^{-2} \sim 7 \times 10^{-4}$ | 0.18 | 15 | 20 |
| Amorphous layer (II) | | $SiH_4/He = 0.5$<br>$C_2H_4$ | $SiH_4 = 15$ | $SiH_4:C_2H_4 = 0.9:9.6$ | 0.18 | 1.5 | 0.3 |

EXAMPLE 46

By means of the preparation device as shown in FIG. 12, an image forming member having oxygen depth profiles in the first and the second layer regions in FIG. 16 was formed under the conditions as indicated in Table 3G.

Other conditions were the same as in Example 44.

Using the thus obtained image forming member, images were formed on transfer papers according to the same procedure and under the same conditions as in Example 44 to obtain a very clear image quality.

TABLE 3G

| Layer constitution | | Gases employed | Flow rate (SCCM) | Flow Rate Ratio | Discharging power (W/cm²) | Layer formation speed (Å/sec) | Layer thickness (μ) |
|---|---|---|---|---|---|---|---|
| Amorphous layer (I) | First layer region | $SiH_4/He = 0.5$<br>NO<br>$PH_3/He = 10^{-3}$ | $SiH_4 = 200$ | $NO/SiH_4 = 1.2 \times 10^{-1} \sim 3 \times 10^{-4}$<br>$PH_3/SiH_4 = 1.5 \times 10^{-3}$ | 0.18 | 15 | 1.0 |
| | Second layer region | $SiH_4/He = 0.5$<br>NO | $SiH_4 = 200$ | $NO/SiH_4 = 3 \times 10^{-4}$ | 0.18 | 8 | 20 |
| Amorphous layer (II) | | $SiH_4/He = 0.5$<br>$C_2H_4$ | $SiH_4 = 100$ | $SiH_4:C_2H_4 = 5:5$ | 0.18 | 8 | 1.5 |

EXAMPLE 47

Layer formations were conducted in entirely the same manner as in Example 44 except that the content ratio of silicon atoms to carbon atoms in the amorphous layer (II) was varied by varying the flow rate ratio of $SiH_4$ gas to $C_2H_4$ gas during formation of the amorphous layer (II). For the thus obtained image forming member, the steps up to transfer were repeated similarly as described in Example 44 for about 50,000 times, followed by evaluation of the image, to obtain the results as shown in Table 4G.

TABLE 4G

| Sample No. | 401G | 402G | 403G | 404G | 405G | 406G | 407G | 408G |
|---|---|---|---|---|---|---|---|---|
| $SiH_4:C_2H_4$ (Flow rate ratio) | 9:1 | 6.4 | 4:6 | 2:8 | 1:9 | 0.5:9.5 | 0.35:9.65 | 0.2:9.8 |
| Si:C (Content ratio) | 9.1 | 7:3 | 5.5:4.5 | 4:6 | 3:7 | 2:8 | 1.2:8.8 | 0.8:9.2 |
| Evaluation of the image quality | Δ | ○ | ◎ | ◎ | ◎ | ○ | Δ | x |

◎: Very good
○ : Good
Δ: Practically satisfactory
x: Liable to form image defect

EXAMPLE 48

Layer formations were conducted in entirely the same manner as in Example 44 except that the layer thickness of the amorphous layer (II) was varied as shown in Table 5G. The results of evaluation are as shown in Table 5G.

TABLE 5G

| Sample No. | Thickness of the amorphous layer (II) (μ) | Results |
|---|---|---|
| 501G | 0.001 | Image defect liable to occur |
| 502G | 0.02 | No image defect during 20,000 repetitions |
| 503G | 0.05 | No image defect during 50,000 repetitions |
| 504G | 2 | Stable for 200,000 repetitions or more |

EXAMPLE 49

Layer formations were conducted in entirely the same manner as in Example 44 except that the methods for forming the first and the second layer regions were changed as indicated in Table 6G, and evaluation of the image quality was performed similarly as in Example 44 to obtain good results.

TABLE 6G

| Layer constitution | | Gases employed | Flow rate (SCCM) | Flow rate ratio | Discharging power (W/cm$^2$) | Layer formation speed (Å/sec) | Layer thickness (μ) |
|---|---|---|---|---|---|---|---|
| Amorphous layer (I) | First layer region | $SiH_4/He = 0.5$<br>$SiF_4/He = 0.5$<br>NO<br>$PH_3/He = 10^{-3}$ | $SiH_4 + SiF_4 = 200$ | $NO/(SiH_4 + SiF_4) = 1 \times 10^{-1} \sim 1 \times 10^{-4}$<br>$PH_3/(SiH_4 + SiF_4) = 4 \times 10^{-3}$ | 0.18 | 15 | 0.6 |
| | Second layer region | $SiH_4/He = 0.5$<br>$SiF_4/He = 0.5$ | $SiH_4 + SiF_4 = 200$ | $NO/(SiH_4 + SiF_4) = 1 \times 10^{-4}$ | 0.18 | 15 | 20 |

EXAMPLE 50

By means of the preparation device as shown in FIG. 12, an image forming member having oxygen depth profiles in the first and the second layer regions in FIG. 17 was formed under the conditions as indicated in Table 7G.

Other conditions were the same as in Example 44.

Using the thus obtained image forming member, images were formed on transfer papers according to the same procedure and under the same conditions as in Example 44 to obtain a very clear image quality.

TABLE 7G

| Layer constitution | | Gases employed | Flow rate (SCCM) | Flow rate ratio | Discharging power (W/cm$^2$) | Layer formation speed (Å/sec) | Layer thickness (μ) |
|---|---|---|---|---|---|---|---|
| Amorphous layer (I) | First layer region | $SiH_4/He = 0.5$<br>NO<br>$PH_3/He = 10^{-3}$ | $SiH_4 = 200$ | $NO/SiH_4 = 8 \times 10^{-2} \sim 1 \times 10^{-2}$<br>$PH_3/SiH_4 = 8 \times 10^{-5}$ | 0.18 | 15 | 2 |
| | Second layer region | $SiH_4/He = 0.5$<br>NO | $SiH_4 = 200$ | $NO/SiH_4 = 1 \times 10^{-2} \sim 1 \times 10^{-4}$ | 0.18 | 15 | 18 |
| Amorphous layer (II) | | $SiH_4/He = 0.5$<br>$C_2H_4$ | $SiH_4 = 50$ | $SiH_4:C_2H_4 = 3:7$ | 0.18 | 6 | 0.5 |

EXAMPLE 51

Image forming members for electrophography were prepared, respectively, according to the same procedure and under the same conditions as shown in Example 46, except that the layer forming conditions were changed to those as indicated in Table 8G during formation of the second layer region in Example 46, and evaluated similarly as in Example 44 to obtain good results for respective samples, particularly with respect to image quality and durability.

TABLE 8G

| Conditions | Gases employed | Flow rate (SCCM) | Flow rate ratio | Layer thickness (μ) |
|---|---|---|---|---|
| 1 | $SiH_4/He = 1$<br>$B_2H_6/He = 10^{-2}$<br>NO | $SiH_4 = 200$ | $B_2H_6/SiH_4 = 2 \times 10^{-5}$<br>$NO/SiH_4 = 3 \times 10^{-4}$ | 15 |
| 2 | $SiH_4/He = 1$<br>$B_2H_6/He = 10^{-2}$<br>NO | $SiH_4 = 200$ | $B_2H_6/SiH_4 = 1 \times 10^{-5}$<br>$NO/SiH_4 = 3 \times 10^{-4}$ | 15 |
| 3 | $Si_2H_6/He = 1$<br>$B_2H_6/He = 10^{-2}$<br>NO | $Si_2H_6 = 170$ | $B_2H_6/Si_2H_6 = 3 \times 10^{-4}$<br>$NO/Si_2H_6 = 3 \times 10^{-4}$ | 10 |
| 4 | $SiH_4/He = 1$<br>$SiF_4/He = 1$<br>$B_2H_6/He = 10^{-2}$<br>NO | $SiH_4 + SiF_4 = 100$ | $SiH_4/SiF_4 = 8/2$<br>$B_2H_6/(SiH_4 + SiF_4) = 2 \times 10^{-5}$<br>$NO/(SiH_4 + SiF_4) = 3 \times 10^{-4}$ | 15 |

EXAMPLE 52

By means of the preparation device as shown in FIG. 13, there was prepared an image forming member having oxygen depth profiles in the first and the second layer regions as shown in FIG. 14 under the conditions as indicated in Table 1H.

The image forming member thus obtained was set in a charging-exposure-developing device, subjected to corona charging at—5.0 kV for 0.2 sec, followed immediately by irradiation of a light image. As the light source, a tungsten lamp was employed and irradiation was effected at a dose of 1.5 lux.sec. using a transmissive type test chart.

Immediately thereafter, a positively charged developer (containing toner and carrier) was cascaded onto the surface of the image forming member, whereby a good toner image was obtained thereon. When the toner image on the member was transferred onto a transfer paper subjected to corona charging at—5.0 kV, there was obtained a clear image with high density which was excellent in resolving power and good in gradation reproduction.

TABLE 1H

| Layer constitution | | Gases employed | Flow rate (SCCM) | Flow rate ratio | Discharging power (W/cm²) | Layer formation speed (Å/sec) | Layer thickness (μ) |
|---|---|---|---|---|---|---|---|
| Amorphous layer (I) | First layer region | $SiH_4/He = 0.5$ NO $PH_3/He = 10^{-3}$ | $SiH_4 = 200$ | $NO/SiH_4 = 1 \times 10^{-1} \sim 1 \times 10^{-4}$ $PH_3/SiH_4 = 8 \times 10^{-4}$ | 0.18 | 15 | 0.6 |
| | Second layer region | $SiH_4/He = 0.5$ NO | $SiH_4 = 200$ | $NO/SiH_4 = 1 \times 10^{-4}$ | 0.18 | 15 | 20 |
| Amorphous layer (II) | | $SiH_4/He = 0.5$ $SiF_4/He = 0.5$ $C_2H_4$ | $SiH_4 + SiF_4 = 50$ | $SiH_4:SiF_4:C_2H_4 = 1.5:1.5:7$ | 0.18 | 6 | 0.5 |

Al substrate temperature: 250° C.
Discharging frequency: 13.56 MHz
Inner pressure during reaction: 0.5 Torr

EXAMPLE 53

By means of the preparation device as shown in FIG. 13, an image forming member having oxygen depth profiles in the first and the second layer regions in FIG. 15 was formed under the conditions as indicated in Table 2H.

Other conditions were the same as in Example 52.

Using the thus obtained image forming member, images were formed on transfer papers according to the same procedure and under the same conditions as in Example 52 to obtain a very clear image quality.

TABLE 2H

| Layer constitution | | Gases employed | Flow rate (SCCM) | Flow rate ratio | Discharging power (W/cm²) | Layer formation speed (Å/sec) | Layer thickness (μ) |
|---|---|---|---|---|---|---|---|
| Amorphous layer (I) | First layer region | $SiH_4/He = 0.5$ NO $PH_3/He = 10^{-3}$ | $SiH_4 = 200$ | $NO/SiH_4 = 3 \times 10^{-2} \sim 2 \times 10^{-2}$ $PH_3/SiH_4 = 1 \times 10^{-3}$ | 0.18 | 15 | 0.8 |
| | Second layer region | $SiH_4/He = 0.5$ NO | $SiH_4 = 200$ | $NO/SiH_4 = 2 \times 10^{-2} \sim 7 \times 10^{-4}$ | 0.18 | 15 | 20 |
| Amorphous layer (II) | | $SiH_4/He = 0.5$ $SiF_4/He = 0.5$ $C_2H_4$ | $SiH_4 + SiF_4 = 15$ | $SiH_4:SiF_4:C_2H_4 = 0.3:0.1:9.6$ | 0.18 | 1.5 | 0.3 |

EXAMPLE 54

By means of the preparation device as shown in FIG. 13, an image forming member having oxygen depth profiles in the first and the second layer regions in FIG. 16 was formed under the conditions as indicated in Table 3H.

Other conditions were the same as in Example 52.

Using the thus obtained image forming member, images were formed on transfer papers according to the same procedure and under the same conditions as in Example 52 to obtain a very clear image quality.

TABLE 3H

| Layer constitution | | Gases employed | Flow rate (SCCM) | Flow rate ratio | Discharging power (W/cm²) | Layer formation speed (Å/sec) | Layer thickness (μ) |
|---|---|---|---|---|---|---|---|
| Amorphous layer (I) | First layer region | $SiH_4/He = 0.5$ NO $PH_3/He = 10^{-3}$ | $SiH_4 = 200$ | $NO/SiH_4 = 1.2 \times 10^{-1} \sim 3 \times 10^{-4}$ $PH_3/SiH_4 = 1.5 \times 10^{-3}$ | 0.18 | 15 | 1.0 |
| | Second layer region | $SiH_4/He = 0.5$ NO | $SiH_4 = 200$ | $NO/SiH_4 = 3 \times 10^{-4}$ | 0.18 | 15 | 20 |
| Amorphous layer (II) | | $SiH_4/He = 0.5$ $SiF_4/He = 0.5$ $C_2H_4$ | $SiH_4 + SiF_4 = 150$ | $SiH_4:SiF_4:C_2H_4 = 3:3:4$ | 0.18 | 10 | 1.5 |

EXAMPLE 55

Image forming members were prepared, respectively, in entirely the same manner as in Example 52 except that the content ratio of silicon atoms to carbon atoms in the amorphous layer (II) was varied by varying the flow rate ratio of $SiH_4$ gas:$SiF_4$ gas:$C_2H_4$ gas of the amorphous layer (II). For each of the thus obtained image forming members, the steps of image formation, development and cleaning as described in Example 52 were repeated for about 50,000 times and the resultant images were evaluated to obtain the results as shown in Table 4H.

TABLE 4H

| Sample No. | 401H | 402H | 403H | 404H | 405H | 406H | 407H | 408H |
|---|---|---|---|---|---|---|---|---|
| $SiH_4:SiF_4:C_2H_4$ | 5:4:1 | 3:3.5:3.5 | 2:2:6 | 1:1:8 | 0.6:0.4:9 | 0.2:0.3:9.5 | 0.2:0.15:9.65 | 0.1:0.1:9.8 |

TABLE 4H-continued

| Sample No. | 401H | 402H | 403H | 404H | 405H | 406H | 407H | 408H |
|---|---|---|---|---|---|---|---|---|
| (Flow rate ratio) Si:C (Content ratio) | 9.1 | 7:3 | 5.5:4.5 | 4:6 | 3:7 | 2:8 | 1.2:8.8 | 0.8:9.2 |
| Evaluation of the image quality | Δ | ○ | ⊙ | ⊙ | ⊙ | ○ | Δ | x |

⊙: Very good
○ : Good
Δ: Practically satisfactory
x: Liable to form image defect

EXAMPLE 56

Image forming members were prepared, respectively, in entirely the same manner as in Example 52 except that the layer thickness of the second amorphous layer (II) was varied. The steps of image formation, development and cleaning as described in Example 52 were repeated to obtain the results as shown in Table 5H.

TABLE 5H

| Sample No. | Thickness of amorphous layer (II) (μ) | Results |
|---|---|---|
| 501H | 0.001 | Image defect liable to occur |
| 502H | 0.02 | No image defect during 20,000 repetitions |
| 503H | 0.05 | Stable for 50,000 repetitions or more |
| 504H | 1 | Stable for 200,000 repetitions or more |

EXAMPLE 57

Layer formations were conducted in entirely the same manner as in Example 52 except that the methods for forming the first and the second layer regions were changed as indicated in Table 6H, and evaluation of the image quality was performed similarly as in Example 52 to obtain good results.

TABLE 6H

| Layer constitution | | Gases employed | Flow rate (SCCM) | Flow rate ratio | Discharging power (W/cm²) | Layer formation speed (Å/sec) | Layer thickness (μ) |
|---|---|---|---|---|---|---|---|
| Amorphous layer (I) | First layer region | $SiH_4/He = 0.5$ $SiF_4/He = 0.5$ NO $PH_3/He = 10^{-3}$ | $SiH_4 + SiF_4 = 200$ | $NO/(SiH_4 + SiF_4) = 1 \times 10^{-1} \sim 1 \times 10^{-4}$ $PH_3/(SiH_4 + SiF_4) = 4 \times 10^{-3}$ | 0.18 | 15 | 0.6 |
| | Second layer region | $SiH_4/He = 0.5$ $SiF_4/He = 0.5$ NO | $SiH_4 + SiF_4 = 200$ | $NO/(SiH_4 + SiF_4) = 1 \times 10^{-4}$ | 0.18 | 15 | 20 |

EXAMPLE 58

By means of the preparation device as shown in FIG. 13, an image forming member having an oxygen depth profile as shown in FIG. 17 was formed under the conditions as indicated in Table 7H.

Other conditions were the same as in Example 52.

Using the thus obtained image forming member, images were formed on transfer papers according to the same procedure and under the same conditions as in Example 52 to obtain a very clear image quality.

TABLE 7H

| Layer constitution | | Gases employed | Flow rate (SCCM) | Flow rate ratio | Discharging power (W/cm²) | Layer formation speed (Å/sec) | Layer thickness (μ) |
|---|---|---|---|---|---|---|---|
| Amorphous layer (I) | First layer region | $SiH_4/He = 0.5$ NO $PH_3/He = 10^{-3}$ | $SiH_4 = 200$ | $NO/SiH_4 = 8 \times 10^{-2} \sim 1 \times 10^{-2}$ $PH_3/SiH_4 = 8 \times 10^{-5}$ | 0.18 | 15 | 2 |
| | Second layer region | $SiH_4/He = 0.5$ NO | $SiH_4 = 200$ | $NO/SiH_4 = 1 \times 10^{-2} \sim 1 \times 10^{-4}$ | 0.18 | 15 | 18 |
| Amorphous layer (II) | | $SiH_4/He = 0.5$ $SiF_4/He = 0.5$ $C_2H_4$ | $SiH_4 + SiF_4 = 50$ | $SiH_4:SiF_4:C_2H_4 = 1.5:1.5:7$ | 0.18 | 6 | 0.5 |

EXAMPLE 59

Image forming members for electrophography were prepared, respectively, according to the same procedure and under the same conditions as shown in Example 54, except that the layer forming conditions were changed to those as indicated in Table 8H during formation of the second layer region in Example 54, and evaluated similarly as in Example 52 to obtain good results for respective samples, particularly with respect to image quality and durability.

TABLE 8H

| Conditions | Gases employed | Flow rate (SCCM) | Flow rate ratio | Layer thickness ($\mu$) |
|---|---|---|---|---|
| 1 | $SiH_4/He = 1$<br>$B_2H_6/He = 10^{-2}$<br>NO | $SiH_4 = 200$ | $B_2H_6/SiH_4 = 2 \times 10^{-5}$<br>$NO/SiH_4 = 3 \times 10^{-4}$ | 15 |
| 2 | $SiH_4/He = 1$<br>$B_2H_6/He = 10^{-2}$<br>NO | $SiH_4 = 200$ | $B_2H_6/SiH_4 = 1 \times 10^{-5}$<br>$NO/SiH_4 = 3 \times 10^{-4}$ | 15 |
| 3 | $Si_2H_6/He = 1$<br>$B_2H_6/He = 10^{-2}$<br>NO | $Si_2H_6 = 170$ | $B_2H_6/Si_2H_6 = 3 \times 10^{-4}$<br>$NO/Si_2H_6 = 3 \times 10^{-4}$ | 10 |
| 4 | $SiH_4/He = 1$<br>$SiF_4/He = 1$<br>$B_2H_6/He = 10^{-2}$<br>NO | $SiH_4 + SiF_4 = 100$ | $SiH_4/SiF_4 = 8/2$<br>$B_2H_6/(SiH_4 + SiF_4) = 2 \times 10^{-5}$<br>$NO/(SiH_4 + SiF_4) = 3 \times 10^{-4}$ | 15 |

We claim:

1. A photoconductive member comprising a support for a photoconductive member, and an amorphous layer exhibiting photoconductivity comprising an amorphous material containing silicon atoms as a matrix, and at least one of hydrogen atoms and halogen atoms, characterized in that said amorphous layer comprises a first layer region extending throughout the entire thickness of said amorphous layer and containing, as constituent atoms, oxygen atoms in a distribution which is nonuniform and continuous in the direction of the layer thickness, and a second layer region containing, as constituent atoms, the atoms (A) belonging to Group III or Group V of the periodic table in a distribution which is continuous in the direction of the layer region thickness, said second layer existing internally beneath the surface of said amorphous layer.

2. A photoconductive member according to claim 1, wherein the first layer region comprises the whole layer region of the amorphous layer.

3. A photoconductive member according to claim 1, wherein the state of distribution of the atoms (A) is uniform in the direction of the layer thickness.

4. A photoconductive member according to claim 1, wherein the oxygen atoms are distributed with greater concentration at the end portion of the layer region on the support side.

5. A photoconductive member according to claim 1, further comprising a second amorphous layer comprising an amorphous material containing silicon atoms and carbon atoms on said amorphous layer exhibiting photoconductivity.

6. A photoconductive member according to claim 5, wherein the amorphous layer containing carbon atoms further contains hydrogen atoms.

7. A photoconductive member according to claim 5, wherein the amorphous layer containing carbon atoms further contains halogen atoms.

8. A photoconductive member according to claim 5, wherein the amorphous layer containing carbon atoms further contains both hydrogen atoms and halogen atoms.

9. A photoconductive member according to claim 1, wherein the second layer region contains atoms belonging to the group V of the periodic table, and the other region (B) of the amorphous layer exhibiting photoconductivity excluding the second layer region contains atoms belonging to group III of the periodic table.

10. A photoconductive member according to claim 1, wherein hydrogen atoms are contained in the amorphous layer exhibiting photoconductivity.

11. A photoconductive member according to claim 1, wherein the content of hydrogen atoms in the amorphous layer is 1 to 40 atomic %.

12. A photoconductive member according to claim 1, wherein halogen atoms are contained in the amorphous layer exhibiting photoconductivity.

13. A photoconductive member according to claim 1, wherein the content of halogen atoms in the amorphous layer is 1 to 40 atomic %.

14. A photoconductive member according to claim 1, wherein both of hydrogen atoms and halogen atoms are contained in the amorphous layer exhibiting photoconductivity.

15. A photoconductive member according to claim 1, wherein the total content of hydrogen atoms and halogen atoms is 1 to 40 atomic %.

16. A photoconductive member according to claim 1, wherein the content of oxygen atoms contained in the first layer region is 0.001 to 30 atomic %.

17. A photoconductive member according to claim 1, wherein the content of the atoms (A) in the second layer region is 0.01 to $5 \times 10^4$ atomic ppm.

18. A photoconductive member according to claim 14, wherein the relation between the layer thickness $T_0$ of the amorphous layer and the layer thickness $t_B$ of the second layer region is $t_B/T_0 \leqq 0.4$.

19. A photoconductive member according to claim 1, wherein the layer thickness of the second layer region is 30 Å to $5\mu$.

20. A photoconductive member according to claim 1, wherein the thickness $T_0$ of the amorphous layer is 1 to $100\mu$.

21. A photoconductive member according to claim 1, wherein the first layer region has the maximum value $C_{max}$ of the distributed concentrations of oxygen atoms at the end portion of the layer region on the support side.

22. A photoconductive member according to claim 21, wherein $C_{max}$ is 10 atomic % or more.

23. A photoconductive member according to claim 21, wherein $C_{max}$ is provided in the layer region within $5\mu$ thickness from the end portion on the support side of the first layer region.

24. A photoconductive member according to claim 9, wherein the content of the atoms belonging to group III of the periodic table in the other layer region (B) is 0.001 to 1000 atomic ppm.

25. A photoconductive member according to claim 5, wherein the layer thickness of the amorphous layer containing carbon atoms is 0.003 to $30\mu$.

* * * * *

UNITED STATES PATENT AND TRADEMARK OFFICE

CERTIFICATE OF CORRECTION

PATENT NO. : 4,501,807

DATED : February 26, 1985

INVENTOR(S) : Shirai, et al.

It is certified that error appears in the above-identified patent and that said Letters Patent is hereby corrected as shown below:

Column 2, line 23, change "taking" to --taken--.

Column 4, line 55, change "many" to --may--.

Column 5, line 2, change "(boron)." to --(boron),--.

Column 5, line 61, after "thickness" delete "(".

Column 6, line 2, after "A" insert --may--.

Column 9, line 10, change "Icl" to --ICl--.

Column 9, line 14, after "preferably" insert --be--.

Column 10, line 17, change "permited" to --permitted--.

Column 11, line 61, change "a" to --an--.

Column 11, line 67, before "gas" insert --a--.

Column 12, line 12, after "according" insert --to--.

Column 14, line 20, after "as" insert --an--.

Column 14, line 25, after "from" insert --the--.

Column 14, line 62, change "when a" to --when an--.

Column 15, line 14, change "give" to --given--.

Column 15, line 29, change "behaviours" to --behaviors--.

UNITED STATES PATENT AND TRADEMARK OFFICE

CERTIFICATE OF CORRECTION

PATENT NO. : 4,501,807

DATED : February 26, 1985

INVENTOR(S) : Shirai, et al.

It is certified that error appears in the above-identified patent and that said Letters Patent is hereby corrected as shown below:

Column 15, line 58, change "a-$(Si_dC_{1-d})_3$" to --a-$(Si_dC_{1-d})_e$--.

Column 15, line 63, before "advantageously" insert --be--.

Column 16, line 2, after "of" insert --the--.

Column 16, line 19, after "not" insert --be--.

Column 16, line 38, after "representation" change "a" to --A--.

Column 16, line 38, before "may" change "a" to --A--.

Column 16, line 57, change "a-$(Si_dC_{1-d})_3$" to --a-$(Si_dC_{1-d})_e$--.

Column 17, line 6, after "of" insert --the--.

Column 17, line 22, before "economical" insert --an--.

Column 17, line 35, after "is" insert --a--.

Column 17, line 37, after "is" insert --a--.

Column 17, line 42, change "as $SiF_4$/He)." to --as "$SiF_4$/He").--.

Column 18, line 44, change "a" to --an--.

Column 18, line 45, change "a" to --an--.

Column 18, line 46, change "a" to --an--.

UNITED STATES PATENT AND TRADEMARK OFFICE

CERTIFICATE OF CORRECTION

PATENT NO. : 4,501,807

DATED : February 26, 1985

INVENTOR(S) : Shirai, et al.

It is certified that error appears in the above-identified patent and that said Letters Patent is hereby corrected as shown below:

Table 5A, symbols for image quality should be beneath layer thickness values.

Table 1B, change " $1 \times 10^{-1} \sim 1 \times 10^{-1}$" to -- $1 \times 10^{-1}$ $1 \times 10^{-4}$--.

Column 40, line 63, change "electrophography" to --electrophotography--.

Table 1F, change "Ar 200" to --Ar-- and insert --200-- under "Flow rate (SCCM)".

Table 4F, change "(Target)" to --Target--.

Column 44, line 2, after "(II)" insert --was varied as shown in Table 5F--.

Table 5F, delete "was varied as shown in Table 5F".

Column 45, line 17, change "electrophography" to --electrophotography--.

Table 3G, under "Layer formation speed" change "8", first occurence, to --15--.

UNITED STATES PATENT AND TRADEMARK OFFICE

CERTIFICATE OF CORRECTION

PATENT NO. : 4,501,807

DATED : February 26, 1985

INVENTOR(S) : Shirai, et al.

It is certified that error appears in the above-identified patent and that said Letters Patent is hereby corrected as shown below:

Column 50, line 24, change " -5.0 kV" to -- - 5.0 kV--.

Column 50, line 49, change " -5.0 kV" to -- - 5.0 kV--.

Table 4H, change "9.1" to --9:1--.

Column 54, line 60, change "electrophography" to --electrophotography--.

Signed and Sealed this

*Sixteenth* Day of *September 1986*

[SEAL]

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,501,807

DATED : February 26, 1985

INVENTOR(S) : Shirai, et al.

It is certified that error appears in the above-identified patent and that said Letters Patent is hereby corrected as shown below:

Column 4, lines 25 and 26, change "and in a nonuniform distribution, but" to --and in a uniform or nonuniform distribution, but--.

Signed and Sealed this

Twenty-sixth Day of March, 1991

*Attest:*

HARRY F. MANBECK, JR.

*Attesting Officer*

*Commissioner of Patents and Trademarks*